US010726988B2

(12) United States Patent
Otsubo et al.

(10) Patent No.: US 10,726,988 B2
(45) Date of Patent: Jul. 28, 2020

(54) INDUCTOR COMPONENT AND MANUFACTURING METHOD FOR INDUCTOR COMPONENT

(71) Applicant: Murata Manufacturing Co., Ltd., Kyoto (JP)

(72) Inventors: Yoshihito Otsubo, Kyoto (JP); Shinichiro Banba, Kyoto (JP); Norio Sakai, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 722 days.

(21) Appl. No.: 15/461,981

(22) Filed: Mar. 17, 2017

(65) Prior Publication Data

US 2017/0186528 A1 Jun. 29, 2017

Related U.S. Application Data

(63) Continuation of application No. PCT/JP2015/076638, filed on Sep. 18, 2015.

(30) Foreign Application Priority Data

Sep. 19, 2014 (JP) ..... 2014-191344
Sep. 22, 2014 (JP) ..... 2014-192371

(51) Int. Cl.
*H01F 27/02* (2006.01)
*H01F 27/28* (2006.01)
(Continued)

(52) U.S. Cl.
CPC ..... *H01F 27/2804* (2013.01); *H01F 17/0013* (2013.01); *H01F 17/0033* (2013.01);
(Continued)

(58) Field of Classification Search
USPC ..... 336/83
See application file for complete search history.

(56) References Cited

U.S. PATENT DOCUMENTS 10,410,782 B2 * 9/2019 Otsubo ..... H01F 17/0033
10,424,430 B2 * 9/2019 Nishide ..... H01F 41/046
(Continued)

FOREIGN PATENT DOCUMENTS

JP 2010-129875 A 6/2010
JP 5270576 B2 8/2013
(Continued)

OTHER PUBLICATIONS

International Search Report issued in Application No. PCT/JP2015/076638 dated Dec. 15, 2015.
(Continued)

*Primary Examiner* — Ronald Hinson
(74) *Attorney, Agent, or Firm* — Pearne & Gordon LLP

(57) ABSTRACT

A technique capable of reducing the resistance of an inductor electrode is provided. A second conductor 6 is constituted by an undercoating layer 11 formed of a conductive paste, and a plating layer 12 formed to cover the undercoating layer 11. Therefore, the second conductor 6 constituting part of the inductor electrode 7 can be formed at a lower cost. Respective first end surfaces 8*a* and 9*a* of first and second metal pins 8 and 9 are connected to each other by the plating layer 12 of the second conductor 6 without interposition of the undercoating layer 11 thereof between them. Hence the resistance of the inductor electrode 7 can be reduced at a lower cost.

16 Claims, 18 Drawing Sheets

(51) Int. Cl.
*H01F 27/29* (2006.01)
*H01F 17/00* (2006.01)
*H01F 41/04* (2006.01)

(52) U.S. Cl.
CPC ..... *H01F 27/292* (2013.01); *H01F 41/041* (2013.01); *H01F 41/043* (2013.01)

(56) References Cited

U.S. PATENT DOCUMENTS

| | | | | |
|---|---|---|---|---|
| 10,553,347 | B2 * | 2/2020 | Banba | H01F 17/0013 |
| 10,573,457 | B2 * | 2/2020 | Wang | H01F 27/2804 |
| 2009/0002111 | A1 * | 1/2009 | Harrison | H01F 19/04 336/69 |
| 2011/0272094 | A1 * | 11/2011 | Dalmia | B29C 39/10 156/293 |
| 2015/0235753 | A1 * | 8/2015 | Chatani | H01F 17/0013 336/200 |
| 2016/0372246 | A1 | 12/2016 | Otsubo | |

FOREIGN PATENT DOCUMENTS

| | | | |
|---|---|---|---|
| JP | 2014-038883 | A | 2/2014 |
| WO | 2015/133310 | A1 | 9/2015 |

OTHER PUBLICATIONS

Written Opinion issued in Application No. PCT/JP2015/076638 dated Dec. 15, 2015.

* cited by examiner

INDUCTOR COMPONENT AND MANUFACTURING METHOD FOR INDUCTOR COMPONENT

This is a continuation of International Application No. PCT/JP2015/076638 filed on Sep. 18, 2015 which claims priority from Japanese Patent Application No. 2014-192371 filed on Sep. 22, 2014 and Japanese Patent Application No. 2014-191344 filed on Sep. 19, 2014. The contents of these applications are incorporated herein by reference in their entireties.

FIELD OF THE DISCLOSURE

The present disclosure relates to an inductor component including an inductor disposed in an insulator, and to a manufacturing method for the inductor component.

DESCRIPTION OF THE RELATED ART

As illustrated in FIG. 21, an inductor component 500 with a transformer built therein has been proposed so far (see Patent Document 1). The inductor component 500 includes a coil core 501 buried in a resin-made insulator (not illustrated), a first inductor electrode 502*a* forming a primary coil, and a second inductor electrode 502*b* forming a secondary coil. The first and second inductor electrodes 502*a* and 502*b* include respectively first and second outer columnar conductors 503*a* and 503*b* that are arrayed along an outer peripheral surface of the coil core 501, and first and second inner columnar conductors 504*a* and 504*b* that are arrayed along an inner peripheral surface of the coil core 501.

The first inductor electrode 502*a* spirally circling around the coil core 501 is formed by connecting respective corresponding ends of the first outer columnar conductors 503*a* and the first inner columnar conductors 504*a* to each other by a plurality of first wiring electrode patterns 505*a* that are formed on or in both principal surfaces of the insulator. Furthermore, the second inductor electrode 502*b* spirally circling around the coil core 501 is formed by connecting respective corresponding ends of the second outer columnar conductors 503*b* and the second inner columnar conductors 504*b* to each other by a plurality of second wiring electrode patterns 505*b* that are formed on or in both the principal surfaces of the insulator.

The first and second inductor electrodes 502*a* and 502*b* further include respectively primary and secondary coil electrode pairs 506*a* and 506*b*, and primary and secondary coil center taps 507*a* and 507*b*. In FIG. 21, the second wiring electrode patterns 505*b*, the secondary coil electrode pair 506*b*, and the secondary coil center tap 507*b*, which form the secondary coil, are expressed by hatching.

Patent Document 1: Japanese Patent No. 5270576 (Paragraphs 0044 to 0046, FIG. 3, etc.)

BRIEF SUMMARY OF THE DISCLOSURE

The first and second wiring electrode patterns 505*a* and 505*b* of the above-described inductor component 500 are formed, by way of example, as follows. First, metal layers are formed on or in both the principal surfaces of the insulator, at which the respective end surfaces of the columnar conductors 503*a*, 503*b*, 504*a* and 504*b* are exposed, by forming metal films with sputtering, or by pasting metal foils. Then, both of the metal layers are etched for patterning with photolithography, for example, whereby the first and second wiring electrode patterns 505*a* and 505*b* are formed on or in both of the principal surfaces of the insulator.

From the viewpoint of reducing the manufacturing cost of the inductor component, it is conceivable to form the first and second wiring electrode patterns 505*a* and 505*b* by employing a conductive paste. In such a case, however, because the conductive paste has higher resistance than the metal film formed by sputtering or than the metal foil, there is a problem that the total resistance of the first and second inductor electrodes 502*a* and 502*b* increases.

The present disclosure has been made in view of the problem described above, and an object of the present disclosure is to provide a technique capable of reducing the resistance of an inductor electrode.

To achieve the above object, the present disclosure provides an inductor component that includes an insulator including a first insulating layer and a second insulating layer laminated on the first insulating layer, and an inductor disposed in the insulator, wherein the inductor includes an inductor electrode, the inductor electrode including a first conductor constituted by first and second columnar conductors both buried in the first insulating layer in a state that respective first end surfaces of the first and second columnar conductors are exposed at a surface of the first insulating layer on the side opposing to the second insulating layer, and a second conductor that is disposed on or in a surface of the second insulating layer on the side opposing to the first insulating layer, that is connected to the first end surface of the first columnar conductor, and that is connected to the first end surface of the second columnar conductor, wherein the second conductor includes an undercoating layer formed using a conductive paste, and a plating layer formed to cover the undercoating layer, and wherein the plating layer is connected to the respective first end surfaces of the first and second columnar conductors to make the first and second columnar conductors connected to each other without interposition of the undercoating layer therebetween.

According to the present disclosure constituted as described above, the first conductor constituting part of the inductor electrode is formed by the first and second columnar conductors both buried in the first insulating layer, and the respective first end surfaces of the first and second columnar conductors are exposed at the surface of the first insulating layer on the side opposing to the second insulating layer. Furthermore, the respective first end surfaces of the first and second columnar conductors are connected to each other by the second conductor that is disposed on or in the surface of the second insulating layer on the side opposing to the first insulating layer, and that constitutes the remaining part of the inductor electrode. The inductor electrode is thus formed. On that occasion, the second conductor includes the undercoating layer formed using a conductive paste, and the plating layer formed to cover the undercoating layer. Since the respective first end surfaces of the first and second columnar conductors are connected to each other by the plating layer of the second conductor without interposition of the undercoating layer thereof between them, the resistance of the inductor electrode can be reduced. Moreover, the second conductor constituting the part of the inductor electrode can be formed at a lower cost.

Preferably, the second conductor is in the form of a line, has a first end portion connected to the first end surface of the first columnar conductor, and has a second end portion connected to the first end surface of the second columnar conductor, the plating layer in the first end portion of the second conductor is formed in a width larger than a maximum width of the first end surface of the first columnar conductor, and the plating layer in the second end portion of the second conductor is formed in a width larger than a maximum width of the first end surface of the second columnar conductor.

With the features described above, reliability of connection between the plating layer in the first end portion of the second conductor and the first end surface of the first columnar conductor can be increased, and reliability of connection between the plating layer in the second end portion of the second conductor and the first end surface of the second columnar conductor can be increased. Furthermore, since the plating layer in each of the first and second end portions of the second conductor is formed in a relatively large width, the undercoating layer in each of the first and second end portions of the second conductor can be formed in a relatively large size with use of the conductive paste. Thus, the plating layer having a larger area can be formed in a short time.

The respective second end surfaces of the first and second columnar conductors of the first conductor may be exposed at a principal surface of the first insulating layer on the side oppositely away from the second insulating layer.

With the feature described above, the inductor component can be provided in a practical structure including the inductor in which the respective second end surfaces of the first and second columnar conductors of the first conductor, those second end surfaces being exposed at the principal surface of the first insulating layer on the side oppositely away from the second insulating layer, can be used as external connection terminals.

Preferably, the second end surfaces are formed respectively to have areas larger than cross-sectional areas of other portions of the first and second columnar conductors.

With the feature described above, since the second end surfaces are formed respectively to have the areas larger than the cross-sectional areas of the other portions of the first and second columnar conductors, contact areas of the external connection terminals can be increased, and bonding strength in mounting the inductor component to a circuit board of an electronic device, etc. can be increased.

Preferably, the first and second columnar conductors are each formed by a metal pin.

With the feature described above, the resistance of the first conductor can be reduced in comparison with the case where the first and second columnar conductors are each made of, e.g., a hardened conductive paste formed into a columnar shape, a plated metal material having grown into a predetermined columnar shape with plating, or a columnar sintered body of metal powder. As a result, the resistance of the inductor electrode can be further reduced.

Preferably, respective end portions of the first and second columnar conductors on the same side as the first end surfaces are each formed in a tapered shape gradually thinning toward a tip end.

With the feature described above, the respective end portions of the first and second columnar conductors on the same side as the first end surfaces are each formed in the tapered shape gradually thinning toward the tip end. Accordingly, when the first and second columnar conductors are expanded due to heating, for example, the respective end portions of the first and second columnar conductors on the same side as the first end surfaces are expanded in such a way that the peripheral surfaces of those end portions are bulged toward the first end surfaces, i.e., toward the second conductor to which the first end surfaces are connected. Thus, because stresses are generated in directions of pressing, toward the second conductor, the insulating layers covering the peripheral surfaces of the respective end portions of the first and second columnar conductors on the same side as the first end surfaces, slippage (relative positional shift) can be prevented from occurring between the surface of the first insulating layer on the side opposing to the second insulating layer and the second conductor near the respective first end surfaces of the first and second columnar conductors. As a result, the inductor component can be provided in which the second conductor of the inductor electrode is prevented from peeling off from the surface of the first insulating layer.

Preferably, the plating layer is bonded to the respective first end surfaces of the first and second columnar conductors by utilizing ultrasonic vibration, and the first and second columnar conductors are connected to each other only by the plating layer.

With the features described above, since the first and second columnar conductors are connected to each other only through the plating layer without intervention of a bonding material such as a solder, the inductor component can be provided which is able to realize further reduction of the resistance of the inductor electrode, which includes the inductor electrode having good electrical characteristics, and which has high reliability with no risk of a drawback such as solder flash.

The first conductor and the second conductor may be bonded to each other with a solder.

With the feature described above, since the second conductor of the inductor electrode can be prevented from peeling off from the surface of the first insulating layer in a region near each of the respective first end surfaces of the first and second metal columnar conductors where the solder is applied for the connection to the second conductor, the inductor component having high reliability can be provided in which the occurrence of a drawback, such as solder flash, is avoided.

The inductor component may further include a coil core that is disposed between the first and second columnar conductors, and that is buried in the first insulating layer.

With the features described above, since the coil core is disposed between the first and second columnar conductors, inductance of the inductor included in the inductor component can increased.

The present disclosure further provides a manufacturing method for an inductor component including an inductor disposed in an insulator, the manufacturing method including a first insulating layer forming step of forming a first insulating layer, which constitutes a part of the insulator, by vertically disposing first and second columnar conductors that constitute a first conductor, and by covering the first and second columnar conductors with resin, an exposing step of exposing respective first end surfaces of the first and second columnar conductors by removing the resin in a surface portion of the first insulating layer with grinding or polishing, a second insulating layer forming step of forming a second insulating layer that constitutes the remaining part of the insulator, and that includes a second conductor formed on or in a surface thereof, the second conductor being in the form of a line and formed by coating a plating layer over an undercoating layer that is formed of a conductive paste, and a connection step of forming an inductor electrode of the inductor by laminating the second insulating layer on the surface of the first insulating layer at which the respective first end surfaces of the first and second columnar conductors are exposed, in a way of connecting a first end portion of the second conductor to the first end surface of the first columnar conductor and connecting a second end portion of the second conductor to the first end surface of the second columnar conductor.

According to the present disclosure constituted as described above, the inductor electrode is formed by laminating the second insulating layer on the surface of the first insulating layer at which the respective first end surfaces of the first and second columnar conductors are exposed in such a state that the plating layer at a surface of the first end portion of the second conductor is connected to the first end surface of the first columnar conductor, and that the plating layer at a surface of the second end portion of the second conductor is connected to the first end surface of the second columnar conductor. It is hence possible to provide the inductor component at a lower cost in which the respective first end surfaces of the first and second columnar conductors are connected to each other by the plating layer of the second conductor without interposition of the undercoating layer thereof between them, and in which the resistance of the inductor electrode is reduced.

The present disclosure still further provides a manufacturing method for an inductor component including an inductor disposed in an insulator, the manufacturing method including a preparation step of preparing an insulating layer that constitutes a part of the insulator, and that includes a conductor formed on or in a surface thereof, the conductor being in the form of a line and formed by coating a plating layer over an undercoating layer that is formed of a conductive paste, a connection step of forming an inductor electrode of the inductor by connecting a first end surface of a first columnar conductor to a first end portion of the conductor, and by connecting a first end surface of a second columnar conductor to a second end portion of the conductor, and a formation step of forming the insulator by supplying resin, used to form the remaining part of the insulator, to the surface of the insulating layer, on or in which the conductor is formed, in a state of covering the first and second columnar conductors.

According to the present disclosure constituted as described above, the conductor being in the form of a line and formed by coating the plating layer over the undercoating layer, which is formed of the conductive paste, is formed on or in the surface of the insulating layer. Then, the first end surface of the first columnar conductor is connected to the plating layer on a surface of the first end portion of the conductor, and the first end surface of the second columnar conductor is connected to the plating layer on a surface of the second end portion of the conductor. It is hence possible to provide the inductor component at a lower cost in which the respective first end surfaces of the first and second columnar conductors are connected to each other by the plating layer of the second conductor without interposition of the undercoating layer thereof between them, and in which the resistance of the inductor electrode is reduced.

The present disclosure still further provides a manufacturing method for an inductor component including an insulator that includes a first resin layer and a second resin layer laminated on one principal surface of the first resin layer, and an inductor, the manufacturing method including a preparation step of preparing the first resin layer in which a first conductor constituted by first and second metal pins having respective end portions on the same side as first end surfaces thereof, each of the end portions being formed in a tapered shape gradually thinning toward a tip end thereof, are buried in a state that the first end surface of each of the first and second metal pins is opposed to the one principal surface of the first resin layer with a predetermined distance held therebetween, a second resin layer overlaying step of overlaying the second resin layer on the one principal surface of the first resin layer in a state of sandwiching a second conductor between the second resin layer and the first resin layer for connection between the respective one end surfaces of the first and second metal pins, the second conductor being formed by forming an undercoating layer on a surface of the second resin layer with use of a conductive paste and by coating a plating layer over the undercoating layer, and a press connection step of forming an inductor electrode of the inductor by pressing the first resin layer and the second resin layer in an overlaying direction in a way of fracturing a surface layer portion of the first resin layer on the side nearer to the one principal surface thereof between each of the respective first end surfaces of the first and second metal pins and the second conductor, and by connecting the respective first end surfaces of the first and second metal pins to the second conductor, wherein a thickness of the surface layer portion of the first resin layer, which portion is positioned on the side nearer to the surface of the first resin layer than each of the respective first end surfaces of the first and second metal pins, is set to a value by which the first resin layer is to be fractured in the press connection step.

According to the present disclosure constituted as described above, the first resin layer is prepared in which the first and second metal pins constituting the first conductor are buried such that the respective first end surfaces of the first and second metal pins are each opposed to the one principal surface of the first resin layer with a predetermined distance held therebetween. Furthermore, the thickness of the surface layer portion of the first resin layer, which portion is positioned on the side nearer to the surface of the first resin layer than each of the respective first end surfaces of the first and second metal pins, is set to the value by which the first resin layer is to be fractured in the press connection step. Therefore, the first resin layer is fractured by the tapered end portions of the first and second metal pins on the same side as the first end surfaces when, in the press connection step, the first resin layer and the second resin layer laminated on one principal surface of the first resin layer are pressed against each other in the overlaying direction with proper pressing force in a way of fracturing the first resin layer between each of the respective first end surfaces of the first and second metal pins and the second conductor. As a result, the respective first end surfaces of the first and second metal pins are connected to the plating layer of the second conductor. It is hence possible to provide the inductor component at a lower cost in which the respective first end surfaces of the first and second metal pins are connected to each other by the plating layer of the second conductor without interposition of the undercoating layer thereof between them, and in which the resistance of the inductor electrode is reduced. In addition, since a step of grinding or polishing the end portions of the first and second metal pins or the resin of the first resin layer is no longer required unlike the related art, the inductor component can be manufactured at a lower cost.

Moreover, the respective end portions of the first and second metal pins on the same side as the first end surfaces are each formed in the tapered shape gradually thinning toward the tip end. Accordingly, when the respective first end surfaces of the first and second metal pins are connected to the second conductor, an angle formed between a peripheral surface of each of the end portions of the first and second metal pins on the same side as the first end surfaces and the surface of the second conductor is an acute angle.

Therefore, when the first and second metal pins are expanded due to heating of the inductor electrode, for example, stresses are generated in directions of pressing, toward the second conductor, the resins covering the peripheral surfaces of the respective end portions of the first and second metal pins on the same side as the first end surfaces. Hence slippage (relative positional shift) can be prevented from occurring between the one principal surface of the first insulating layer and the second conductor near the respective first end surfaces of the first and second metal pins. As a result, the inductor component can be provided at a lower cost in which the second conductor of the inductor electrode is prevented from peeling off from the surface (one principal surface) of the first resin layer.

Preferably, ultrasonic vibration is applied when pressing is performed in the press connection step.

With the feature described above, since the ultrasonic vibration is applied, the surface layer portion of the first resin layer, which portion is positioned on the side nearer to the surface of the first resin layer than each of the respective first end surfaces of the first and second metal pins, can be fractured reliably. Connection strength between each of the respective first end surfaces of the first and second metal pins and the second conductor can also be increased with the application of the ultrasonic vibration.

According to the present disclosure, the respective first end surfaces of the first and second columnar conductors are connected to each other by the plating layer on or in the surface of the second conductor, which is in the form of a line, and which is constituted by the undercoating layer formed of a conductive paste and the plating layer formed to cover the undercoating layer, without interposition of the undercoating layer of the second conductor therebetween. Hence the resistance of the inductor electrode can be reduced.

BRIEF DESCRIPTION OF THE SEVERAL VIEWS OF THE DRAWINGS

Each of FIGS. 2A, 2B and 2C is a sectional view of the inductor component illustrated in FIG. 1; specifically.

Each of FIGS. 3A and 3B is a partial enlarged view of FIG. 2B; specifically.

Each of FIGS. 4A to 4G illustrates one example of a manufacturing method for the inductor component illustrated in FIG. 1; specifically.

Each of FIGS. 5A to 5G illustrates another example of the manufacturing method for the inductor component illustrated in FIG. 1; specifically.

Each of FIGS. 6A to 6E illustrates still another example of the manufacturing method for the inductor component illustrated in FIG. 1; specifically.

Each of FIGS. 7A and 7B illustrates an inductor component according to a second embodiment of the present disclosure; specifically.

Each of FIGS. 8A and 8B illustrates a modification of a coil core; specifically.

Each of FIGS. 10A, 10B and 10C is a sectional view of an inductor component according to a fourth embodiment of the present disclosure; specifically.

Each of FIGS. 12A to 12F illustrates one example of a manufacturing method for the inductor component illustrated in FIG. 10; specifically.

Each of FIGS. 13A to 13G illustrates another example of the manufacturing method for the inductor component illustrated in FIGS. 10A, 10B and 10C; specifically.

Each of FIGS. 14A to 14G illustrates still another example of the manufacturing method for the inductor component illustrated in FIGS. 10A, 10B and 10C; specifically.

Each of FIGS. 15A and 15B illustrates a modification of the inductor component illustrated in FIGS. 10A, 10B and 10C; specifically.

Each of FIGS. 16A and 16B is an explanatory view referenced to explain a manufacturing method for an inductor component according to a fifth embodiment of the present disclosure; specifically.

Each of FIGS. 20A and 20B illustrates an inductor component according to an eighth embodiment of the present disclosure; specifically.

DETAILED DESCRIPTION OF THE DISCLOSURE

First Embodiment

Figure 1:
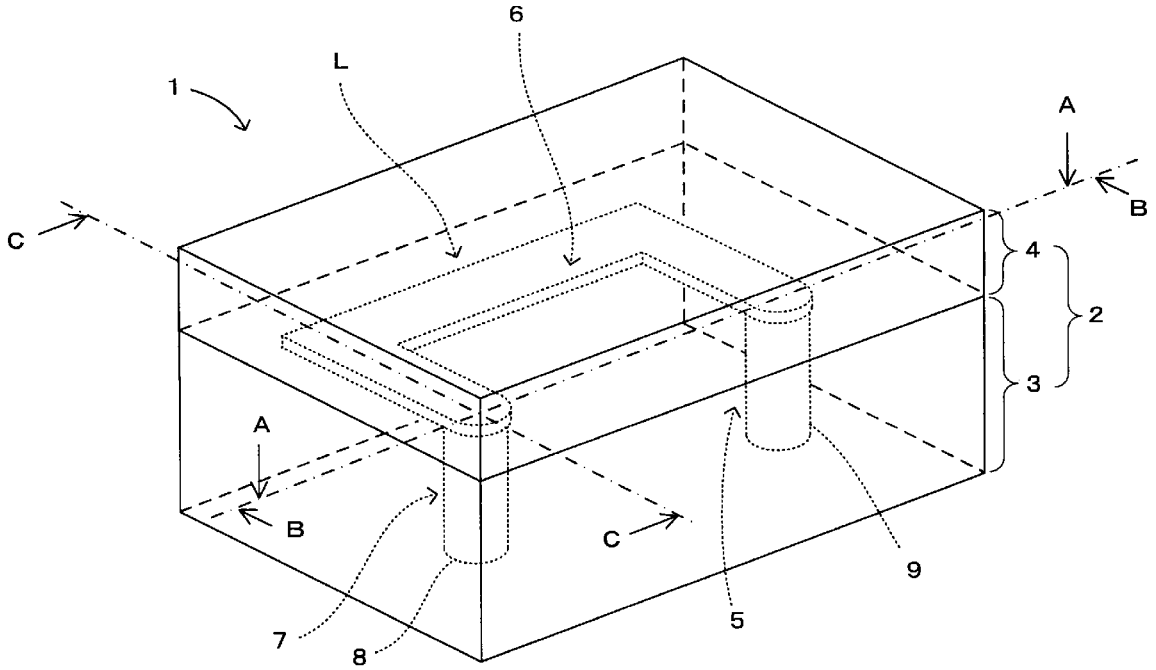
FIG. 1 is a perspective view of an inductor component according to a first embodiment of the present disclosure.

An inductor component according to a first embodiment of the present disclosure will be described below.

(Structure of Inductor Component)

A structure of the inductor component is described with reference to FIGS. 1 to 3B.

As illustrated in FIGS. 1 and 2A to 2C, the inductor component 1 includes an insulator 2, and an inductor L disposed in the insulator 2.

The insulator 2 includes a first resin layer 3 and a second resin layer 4 that is laminated on the first resin layer 3. The first and second resin layers 3 and 4 are each made of, e.g., a magnetic-substance containing resin in which an insulating thermosetting resin and magnetic filler, such as ferrite powder, are mixed with each other. The resin constituting the magnetic-substance containing resin is not limited to the thermosetting type, and the magnetic-substance containing resin may be formed of a photo-curable resin, for example. Depending on materials of a first conductor 5 and a second conductor 6 both described later, the insulator 2 may be formed of a sintered body of magnetic powder, such as ferrite powder, instead of the magnetic-substance containing resin. It is to be noted that the first resin layer 3 corresponds to a "first insulating layer" in the present disclosure, and that the second resin layer 4 corresponds to a "second insulating layer" in the present disclosure.

The inductor L includes an inductor electrode 7 including both the first conductor 5 constituted by first and second metal pins 8 and 9, and the second conductor 6. The first and second metal pins 8 and 9 are buried in the first resin layer 3 such that their first end surfaces 8*a* and 9*a* are exposed at a surface of the first resin layer 3 on the side opposing to the second resin layer 4, and that their second end surfaces 8*b* and 9*b* are exposed at a principal surface of the first resin layer 3 on the side oppositely away from the second resin layer 4.

In this embodiment, external connection terminals (input/output terminals) of the inductor component 1 are formed by the respective second end surfaces 8*b* and 9*b* of the first and second metal pins 8 and 9, which are exposed at the surface of the first resin layer 3. The first and second metal pins 8 and 9 are each made of a material selected from Cu, Cu alloys such as a Cu—Ni alloy and a Cu—Fe alloy, Fe, Au, Ag, and Al. Moreover, the first and second metal pins 8 and 9 are each formed, for example, by shearing a wire rod of a metal conductor, which has a desired diameter and has a circular or polygonal sectional shape, in a predetermined length.

Thus, the first and second metal pins 8 and 9 of the inductor component 1 are each formed of a metal wire having a predetermined shape and strength. In other words, the first and second metal pins 8 and 9 are each a member different from a metal member in the form of a line, such as a hardened conductive paste, a plated metal material having grown into a predetermined shape with plating, or a sintered body of metal powder. Namely, the first and second metal pins 8 and 9 are each a member instead of a through-hole conductor or a via conductor, which is formed to extend perpendicularly to a top surface and a bottom surface of the insulator.

Respective end portions of the first and second metal pins 8 and 9 on the same side as the second end surfaces 8*b* and 9*b* may be formed in larger diameters than the other portions of the first and second metal pins 8 and 9 such that the first and second metal pins 8 and 9 are each formed in a substantially inverted-T shape when viewed from a side. Alternatively, the respective end portions of the first and second metal pins 8 and 9 on the same side as the second end surfaces 8*b* and 9*b* may be formed to gradually thicken toward the second end surfaces 8*b* and 9*b* such that respective areas of the second end surfaces 8*b* and 9*b* are larger than cross-sectional areas of other portions of the first and second metal pins 8 and 9, the other portions being buried in the first resin layer 3. With the above feature, since the respective areas of the second end surfaces 8*b* and 9*b* of the first and second metal pins 8 and 9 functioning as the external connection terminals can be increased, a contact area of each pin with respect to a bonding material, e.g., a solder, can be increased when the inductor component 1 is mounted to a circuit board of an electronic device, etc.

Furthermore, as illustrated in FIGS. 2A to 2C and FIG. 3A, a dam-shaped projection is formed of resin, e.g., polyimide, on a surface of the second resin layer 4 on the side opposing to the first resin layer 3 along an outer periphery of the second conductor 6 that is in the form of a line angled into the shape of a stapler's staple when viewed from above. A dam member 10 serving to dam a plating layer 12, which forms the second conductor 6, is formed by the dam-shaped projection. In a region of the surface of the second resin layer 4 on the side opposing to the first resin layer 3, the region being surrounded by the dam member 10, the second conductor 6 includes an undercoating layer 11 formed by printing a conductive paste that contains, e.g., Cu or Ag, as metal filler, and the plating layer 12 formed to cover the undercoating layer 11. The dam member 10 is formed such that its height from the surface of the second resin layer 4 is larger than a height of the second conductor 6 from the surface of the second resin layer 4.

In this embodiment, the plating layer 12 is formed by a Cu layer 12*a* covering the undercoating layer 11, a Ni layer 12*b* formed on or in a surface of the Cu layer 12*a*, and an Au layer 12*c* formed on or in a surface of the Ni layer 12*b*. The plating layer 12 in a first end portion 6*a* of the second conductor 6 is connected to the first end surface 8*a* of the first metal pin 8, and the plating layer 12 in a second end portion 6*b* of the second conductor 6 is connected to the first end surface 9*a* of the second metal pin 9.

Figure 2A:
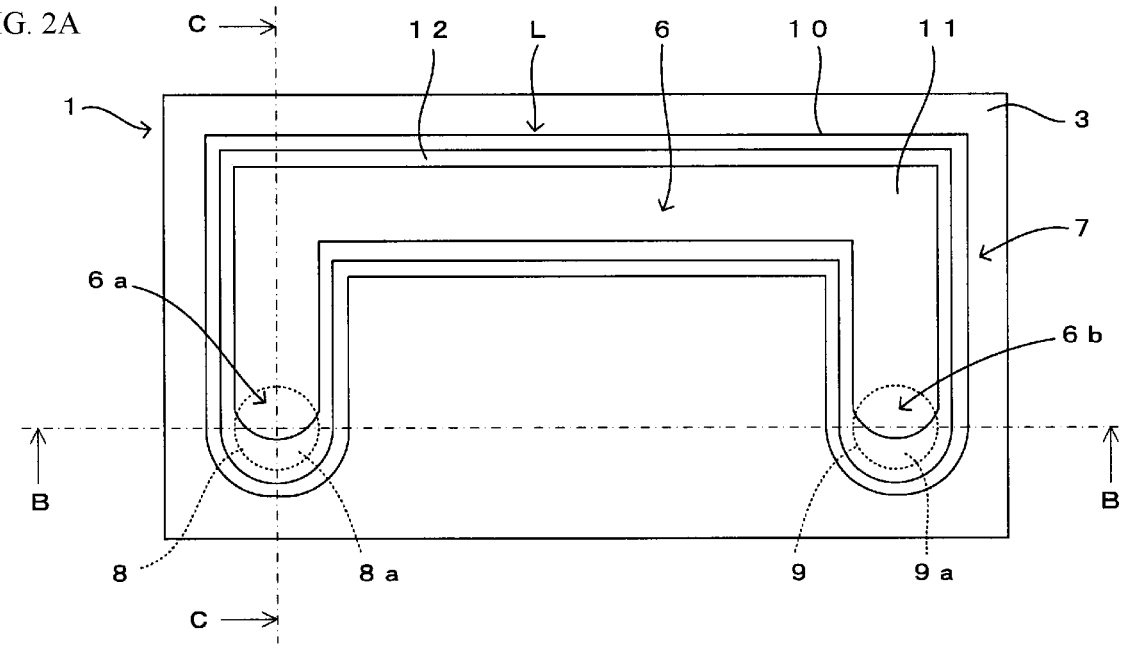
FIG. 2A is a sectional view taken along a line A-A in FIG. 1 and looking in a direction denoted by the arrow.
Figure 2B:
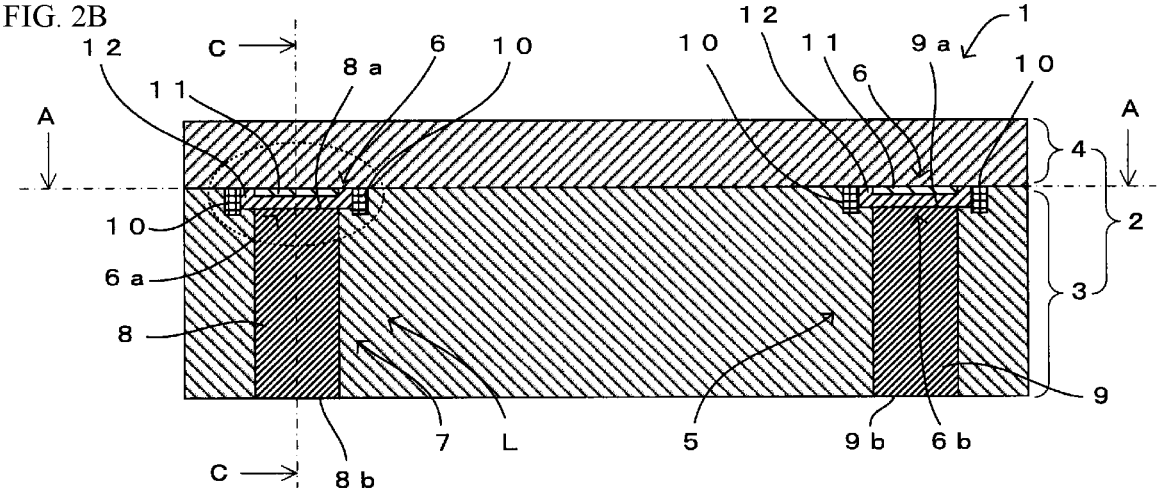
FIG. 2B is a sectional view taken along a line B-B in FIG. 1 and looking in a direction denoted by the arrow.
Figure 2C:
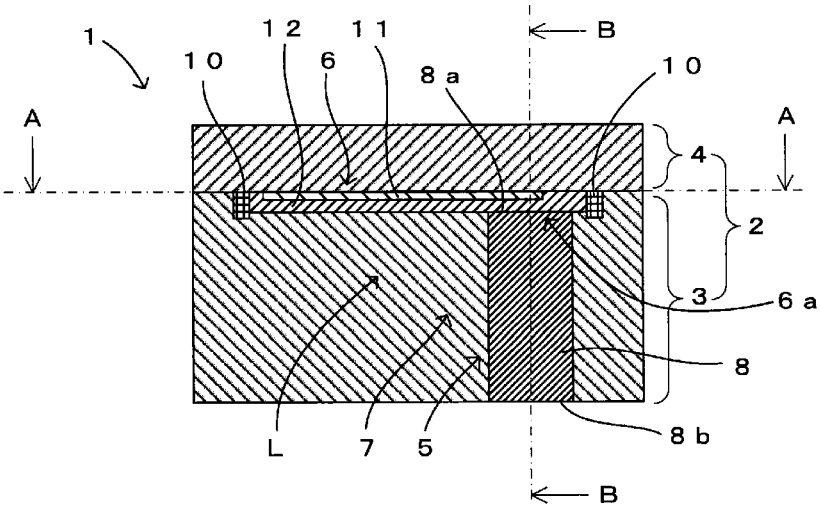
FIG. 2C is a sectional view taken along a line C-C in FIG. 1 and looking in a direction denoted by the arrow.
Figure 3A:
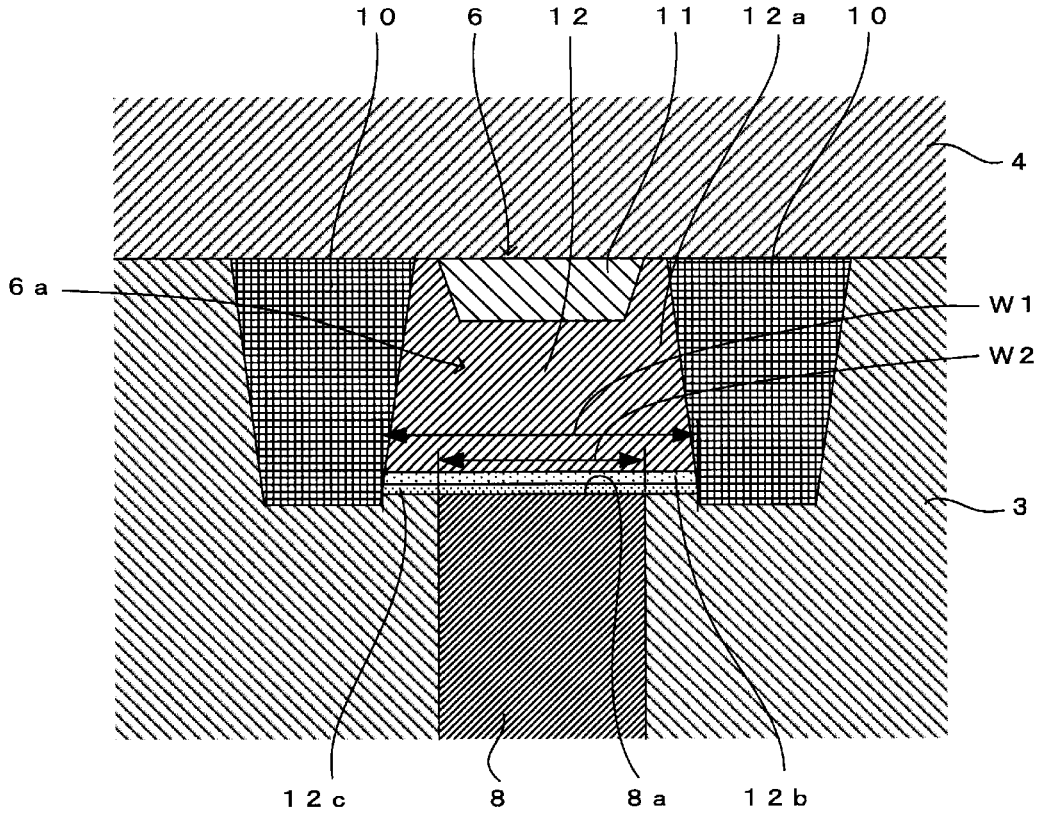
FIG. 3A illustrates a region surrounded by a dotted line in FIG. 2B.

In this embodiment, as illustrated in FIGS. 2B and 3A, the plating layer 12 in the first end portion 6*a* of the second conductor 6 is formed in a width W1 larger than a maximum width W2 of the first end surface 8*a* of the first metal pin 8. Moreover, although the same reference signs as those used in the above description are used here, the plating layer 12 in the second end portion 6*b* of the second conductor 6 is formed in a width W1 larger than a maximum width W2 of the first end surface 9*a* of the second metal pin 9. Accordingly, it is possible to improve reliability of the connection between the plating layer 12 in the first end portion 6*a* of the second conductor 6 and the first end surface 8*a* of the first metal pin 8, and to improve reliability of the connection between the plating layer 12 in the second end portion 6*b* of the second conductor 6 and the first end surface 9*a* of the second metal pin 9.

Figure 3B:
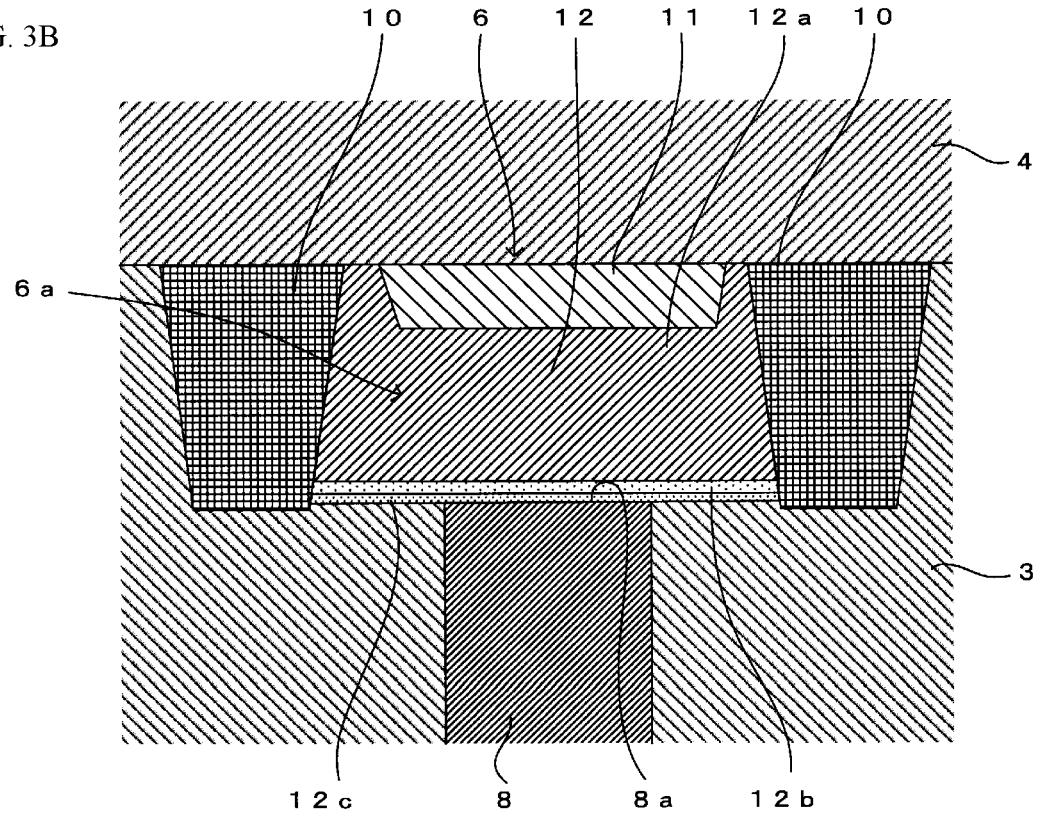
FIG. 3B illustrates a modification of FIG. 3A.

In addition, since the plating layer 12 in each of the first and second end portions 6*a* and 6*b* of the second conductor 6 is formed in a relatively large width, the undercoating layer 11 in each of the first and second end portions 6*a* and 6*b* of the second conductor 6 can be formed in an optionally increased size and area with use of the conductive paste. Thus, as illustrated in FIG. 3B by way of example, the plating layer 12 having a larger area can be formed in a short time by forming the undercoating layer 11 in the increased size and area. Stated in another way, since only the plating layer 12 of the second conductor 6 is connected to the first end surfaces 8*a* and 9*a* of the first and second metal pins 8 and 9, the plating layer 12 having a large area can be formed in a short time by forming the undercoating layer 11 in the optionally increased size and area with use of the conductive paste, which has higher resistance than the plating layer 12, regardless of the widths and the areas of the first end surfaces 8*a* and 9*a* of the first and second metal pins 8 and 9.

The shape of the second conductor 6 when viewed from above is not limited to the above-described exemplary shape, and the second conductor 6 may be formed in, e.g., a substantially L-shape, a linear shape, or a meander shape when viewed from above. Furthermore, the shape of the second conductor 6 when viewed from above is not limited to a line, and the second conductor 6 may be formed into the shape of, e.g., a flat plate when viewed from above. Thus, depending on the required magnitude of inductance, the second conductor 6 may be formed in any desired shape when viewed from above. A portion of the plating layer 12, the portion covering the undercoating layer 11, may be formed of another noble metal, such as Au, instead of Cu.

In the above description, the first metal pin 8 corresponds to a "first columnar conductor" in the present disclosure, and the second metal pin 9 corresponds to a "second columnar conductor" in the present disclosure.

(Manufacturing Method for Inductor Component)

A manufacturing method for the inductor component will be described below. For the sake of easiness in explanation, the following description is made in connection with an example of manufacturing one inductor component 1. The plurality of inductor components 1 may be manufactured at the same time by forming the plurality of inductor components 1 together in accordance with the manufacturing method described below, and then dividing the plurality of inductor components 1 in the integral form into individual pieces.

1. One Example of Manufacturing Method

One example of the manufacturing method is described with reference to FIGS. 4A to 4G.

Figure 4A:
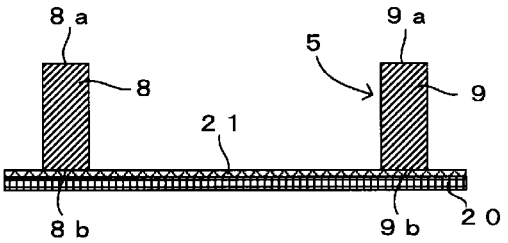
FIGS. 4A to 4G represent different steps.
Figure 4D:
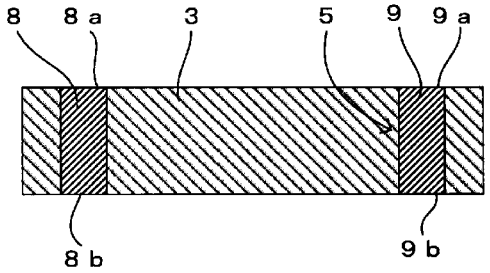
Figure 4B:
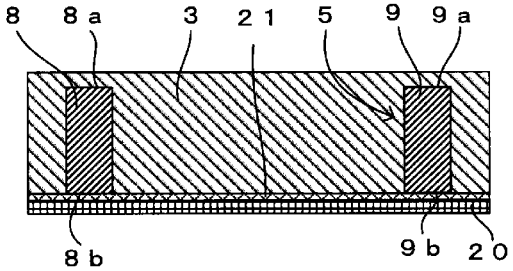

First, as illustrated in FIG. 4A, a coupling plate 20 including an adhesive layer 21 formed on or in one principal surface thereof is prepared. The first and second metal pins 8 and 9 are vertically disposed on the one principal surface of the coupling plate 20 at predetermined positions by attaching, to the adhesive layer 21, the respective second end surfaces 8*b* and 9*b* of the first and second metal pins 8 and 9 that constitute the first conductor 5. Then, as illustrated in FIG. 4B, the first resin layer 3 constituting a part of the insulator 2 is formed by covering the first and second metal pins 8 and 9 with a magnetic-substance containing resin, and by thermally curing the resin (first insulating layer forming step).

Figure 4E:
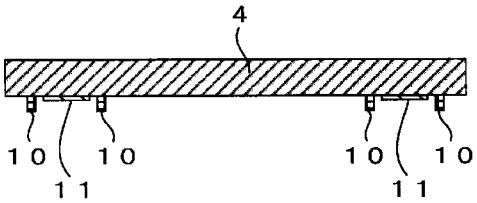
Figure 4C:
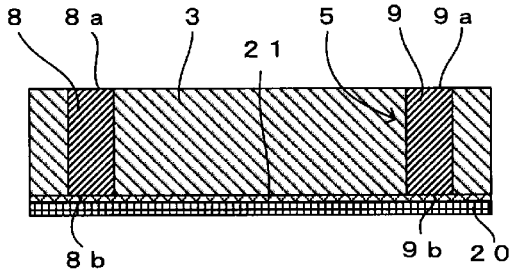

Then, as illustrated in FIG. 4C, the resin on an upper surface of the first resin layer 3 (i.e., its surface opposing to the second resin layer 4) is removed by polishing or grinding to make the respective first end surfaces 8*a* and 9*a* of the first and second metal pins 8 and 9 exposed at the surface of the first resin layer 3 (exposing step). Then, as illustrated in FIG. 4D, the coupling plate 20 is peeled off and removed from the first resin layer 3 (peeling-off step). It is to be noted that, in the manufacturing method of this example, the step illustrated in FIG. 4D may be executed after a later-described step illustrated in FIG. 4G.

Figure 4F:
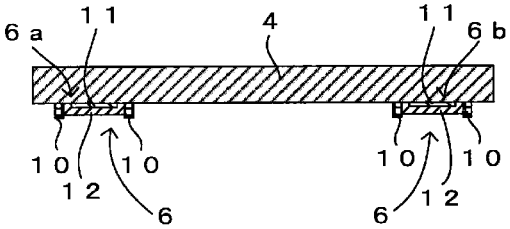

Then, the second resin layer 4 constituting the remaining part of the insulator 2 is prepared, by way of example, as follows. First, as illustrated in FIG. 4E, the undercoating layer 11 of the second conductor 6, having a predetermined pattern shape and being in the form of a line, is formed on or in a lower surface of the second resin layer 4 (i.e., its surface opposing to the first resin layer 3) with a printing process using a conductive paste. Then, the dam member 10 is formed using resin, e.g., polyimide, around the undercoating layer 11 having the predetermined pattern shape and being in the form of a line. Then, as illustrated in FIG. 4F, the second conductor 6 is formed by forming the plating layer 12 with a plating process to cover the undercoating layer 11 in a region of the lower surface of the second resin layer 4 on the inner side surrounded by the dam member 10, thus completing the second resin layer 4 (second insulating layer forming step). The plating process is performed plural times as required in order to form plating films of different materials. The plating layer 12 is formed continuously from the first end portion 6*a* to the second end portion 6*b*.

Figure 4G:
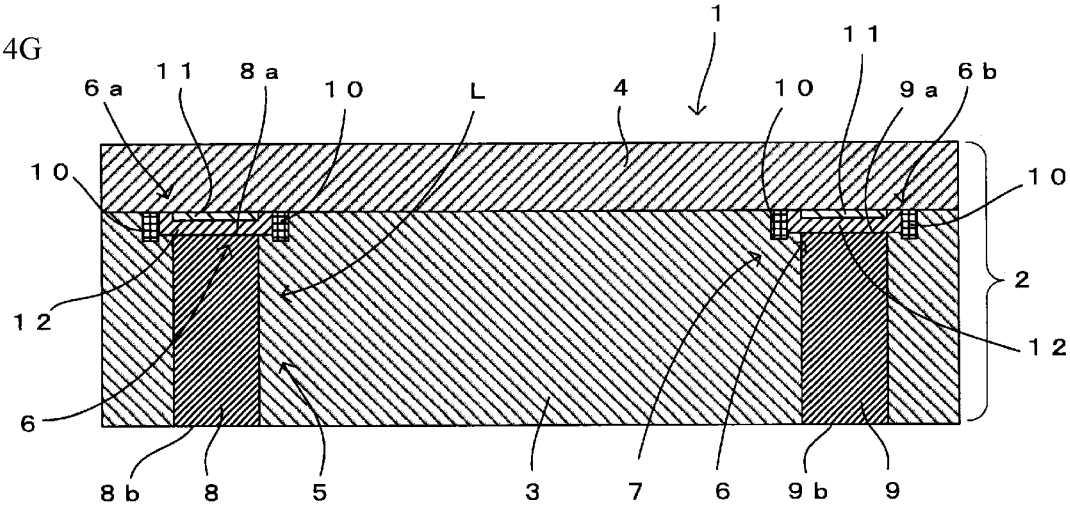

Then, as illustrated in FIG. 4G, the second resin layer 4 is laminated on the upper surface of the first resin layer 3, at which the respective first end surfaces 8*a* and 9*a* of the first and second metal pins 8 and 9 are exposed, in such a state that the second conductor 6 is opposed to the upper surface of the first resin layer 3. Then, the first end portion 6*a* of the second conductor 6 is connected to the first end surface 8*a* of the first metal pin 8, and the second end portion 6*b* of the second conductor 6 is connected to the first end surface 9*a* of the second metal pin 9, thereby forming the inductor electrode 7 of the inductor L (connection step). As a result, the inductor component 1 is completed.

As described above, the inductor electrode 7 is formed by laminating the second resin layer 4 on the surface of the first resin layer 3, at which the respective first end surfaces 8*a* and 9*a* of the first and second metal pins 8 and 9 are exposed, in order that the plating layer 12 on a surface of the first end portion 6*a* of the second conductor 6 is connected to the first end surface 8*a* of the first metal pin 8, and that the plating layer 12 on a surface of the second end portion 6*b* of the second conductor 6 is connected to the first end surface 9*a* of the second metal pin 9. Accordingly, the respective first end surfaces 8*a* and 9*a* of the first and second metal pins 8 and 9 are directly connected to each other by the plating layer 12, which is formed continuously from the first end portion 6*a* connected to the first end surface 8*a* up to the second end portion 6*b* connected to the first end surface 9*a*, without interposition of the undercoating layer 11 of the second conductor 6 therebetween. Hence the inductor component 1 can be readily provided at a lower cost in which the resistance of the inductor electrode 7 is reduced.

In the connection step, the first conductor 5 and the second conductor 6 may be connected to each other with a bonding material, e.g., a solder. Alternatively, the first conductor 5 and the second conductor 6 may be connected to each other by utilizing ultrasonic vibration, for example. Furthermore, which ones of the steps illustrated in FIGS. 4A to 4D and the steps illustrated in FIGS. 4E and 4F are to be executed first is optionally selectable. As an alternative, those steps may be executed at the same time. Stated in another way, it is just required that the inductor component 1 can be formed by finally laminating the first resin layer 3 and the second resin layer 4, which have been prepared separately.

2. Another Example of Manufacturing Method

Another example of the manufacturing method is described with reference to FIGS. 5A to 5G.

Figure 5A:
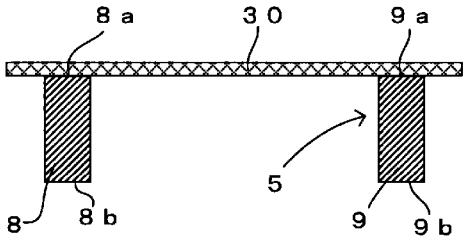
FIGS. 5A to 5G represent different steps.

First, as illustrated in FIG. 5A, a transfer plate 30 is prepared which supports, at one principal surface thereof, the respective first end surfaces 8*a* and 9*a* of the first and second metal pins 8 and 9 both constituting the first conductor 5. An adhesive layer (not illustrated) is formed on or in the one principal surface of the transfer plate 30 to be able to support the respective first end surfaces 8*a* and 9*a* of the first and second metal pins 8 and 9. The first and second metal pins 8 and 9 are supported to the one principal surface of the transfer plate 30 by attaching the respective first end surfaces 8*a* and 9*a* of the first and second metal pins 8 and 9 to the one principal surface of the transfer plate 30 in such a state that the first and second metal pins 8 and 9 are positioned with a spacing therebetween at which the inductor L of the inductor component 1 can exhibit the desired inductance.

Figure 5D:
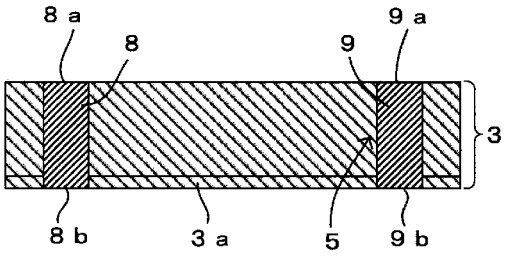
Figure 5B:
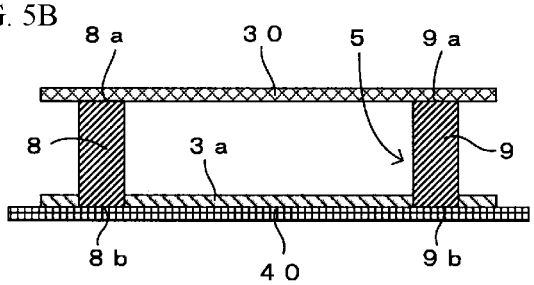

Then, as illustrated in FIG. 5B, a release sheet 40 is prepared. On one principal surface of the release sheet 40, a support layer 3*a* constituting a part of the first resin layer 3 and being in a not-yet-cured state is formed by coating the one principal surface with the magnetic-substance containing resin in a thickness of about 50 to 100 μm, for example. Alternatively, the support layer 3*a* may be formed by placing a resin sheet, which has been separately fabricated, on the release sheet 40. The release sheet 40 can be prepared by forming a release layer on a resin sheet made of, e.g., polyethylene terephthalate, polyethylene naphthalate, or polyimide, or by employing a resin sheet that has the release function in itself, such as a fluorine resin sheet.

Then, the first and second metal pins 8 and 9 supported to the transfer plate 30 are vertically disposed on the one principal surface of the release sheet 40 at predetermined positions by causing the respective end portions of the first and second metal pins 8 and 9 on the same side as the second end surfaces 8*b* and 9*b* to enter the support layer 3*a* until the second end surfaces 8*b* and 9*b* come into contact with the release sheet 40. Then, the support layer 3*a* is thermally cured. With the thermal curing of the support layer 3*a*, the respective end portions of the first and second metal pins 8 and 9 on the same side as the second end surfaces 8*b* and 9*b* are supported by the support layer 3*a*.

When the not-yet-cured support layer 3*a* is thermally cured, the magnetic-substance containing resin forming the support layer 3*a* is preferably caused to rise with wetting properties over outer peripheral surfaces of the respective end portions of the first and second metal pins 8 and 9 on the same side as the second end surfaces 8*b* and 9*b*. With such a feature, a support (not illustrated) formed by the magnetic-substance containing resin, which has risen in the form of a fillet over each of the outer peripheral surfaces of the respective end portions of the first and second metal pins 8 and 9 on the same side as the second end surfaces 8*b* and 9*b*, is formed integrally with the support layer 3*a* after being cured. Hence strength in supporting the first and second metal pins 8 and 9 by the cured support layer 3*a* can be increased.

The shape of the fillet-like support can be adjusted by changing the type or the amount of the magnetic-substance containing resin that forms the first resin layer 3 (i.e., the insulator 2), or by surface-treating the first and second metal pins 8 and 9 and adjusting their wetting properties.

Figure 5E:
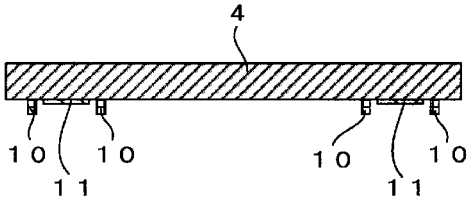
Figure 5C:
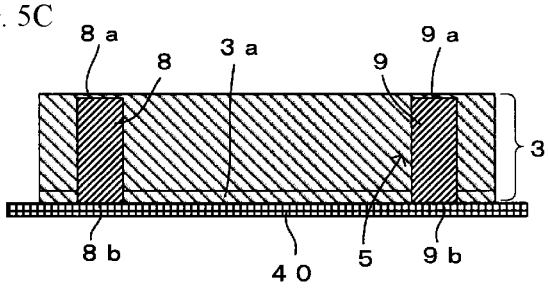

Then, as illustrated in FIG. 5C, the transfer plate 30 is removed, and the same magnetic-substance containing resin as that used to form the support layer 3*a* is supplied onto the support layer 3*a*, thus forming the first resin layer 3 that covers the first and second metal pins 8 and 9 (first insulating layer forming step). Then, as illustrated in FIG. 5D, after peeling off and removing the release sheet 40 (peeling-off step), the resin on the front and rear surfaces of the first resin layer 3 is removed by polishing or grinding to make the first end surfaces 8*a* and 9*a* and the second end surfaces 8*b* and 9*b* of the first and second metal pins 8 and 9 exposed at the surfaces of the first resin layer 3 (exposing step).

The first resin layer 3 may be formed by forming the support layer 3*a* with use of the magnetic-substance containing resin in a liquid state, and by arranging the magnetic-substance containing resin on the support layer 3*a*. The support layer 3*a* and a resin layer formed on the support layer 3*a* may be formed using different types of magnetic-substance containing resins. Here, the different types of magnetic-substance containing resins imply resins in which the contents of magnetic fillers are the same, but the types thereof are different, resins in which the types of magnetic fillers are the same, but the contents thereof are different, resins in which the contents and the types of magnetic fillers are both different, or resins in which the types of insulating resins are different.

Figure 5F:
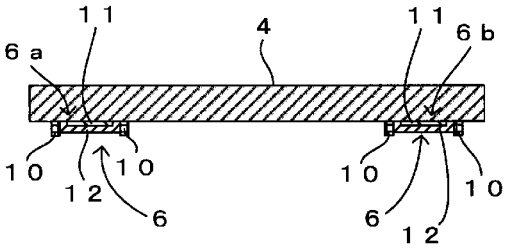

Then, the second resin layer 4 constituting the remaining part of the insulator 2 is prepared, by way of example, as follows. First, as illustrated in FIG. 5E, the undercoating layer 11 of the second conductor 6, having the predetermined pattern shape and being in the form of a line, is formed on or in the lower surface of the second resin layer 4 (i.e., its surface opposing to the first resin layer 3) with a printing process using a conductive paste. Then, the dam member 10 is formed using resin, e.g., polyimide, around the undercoating layer 11 having the predetermined pattern shape and being in the form of a line. Then, as illustrated in FIG. 5F, the second conductor 6 is formed by forming the plating layer 12 with a plating process to cover the undercoating layer 11 in a region of the lower surface of the second resin layer 4 on the inner side surrounded by the dam member 10, thus completing the second resin layer 4 (second insulating layer forming step). The plating process is performed plural times as required in order to form plating films of different materials. The plating layer 12 is formed continuously from the first end portion 6*a* to the second end portion 6*b*.

Figure 5G:
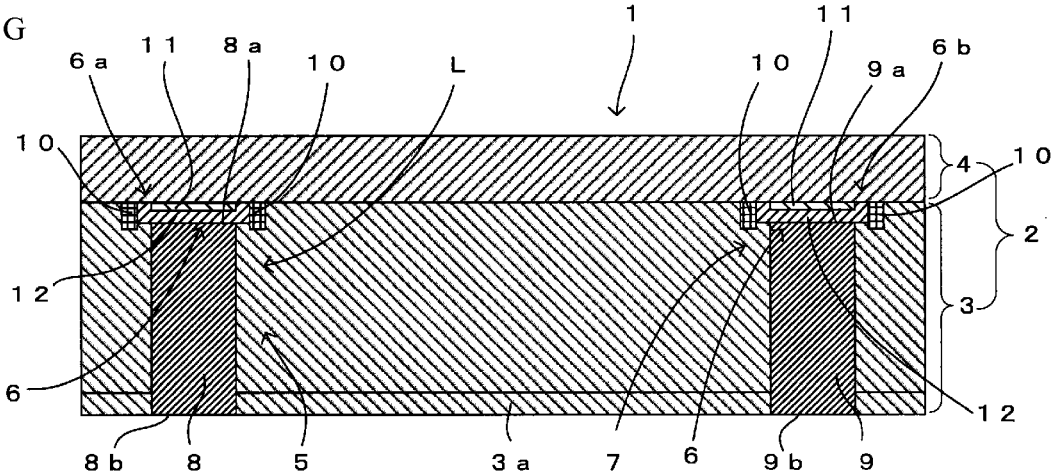

Then, as illustrated in FIG. 5G, the second resin layer 4 is laminated on the upper surface of the first resin layer 3, at which the respective first end surfaces 8*a* and 9*a* of the first and second metal pins 8 and 9 are exposed, in such a state that the second conductor 6 is opposed to the upper surface of the first resin layer 3. Then, the first end portion 6*a* of the second conductor 6 is connected to the first end surface 8*a* of the first metal pin 8, and the second end portion 6*b* of the second conductor 6 is connected to the first end surface 9*a* of the second metal pin 9, thereby forming the inductor electrode 7 of the inductor L (connection step). As a result, the inductor component 1 is completed.

As in "1. One Example of Manufacturing Method" described above, in the connection step, the first conductor 5 and the second conductor 6 may be connected to each other with a bonding material, e.g., a solder. Alternatively, the first conductor 5 and the second conductor 6 may be connected to each other by utilizing ultrasonic vibration, for example. Furthermore, which ones of the steps illustrated in FIGS. 5A to 5D and the steps illustrated in FIGS. 5E and 5F are to be executed first is optionally selectable. As an alternative, those steps may be executed at the same time. Stated in another way, it is just required that the inductor component 1 can be formed by finally laminating the first resin layer 3 and the second resin layer 4, which have been prepared separately.

Thus, as in "1. One Example of Manufacturing Method" described above, the inductor component 1 can be readily provided at a lower cost in which the resistance of the inductor electrode 7 is reduced with the feature that the respective first end surfaces 8*a* and 9*a* of the first and second metal pins 8 and 9 are directly connected to each other by the plating layer 12, which is formed continuously from the first end portion 6*a* connected to the first end surface 8*a* up to the second end portion 6*b* connected to the first end surface 9*a*, without interposition of the undercoating layer 11 of the second conductor 6 therebetween.

3. Still Another Example of Manufacturing Method

Still another example of the manufacturing method is described with reference to FIGS. 6A to 6E.

Figure 6A:
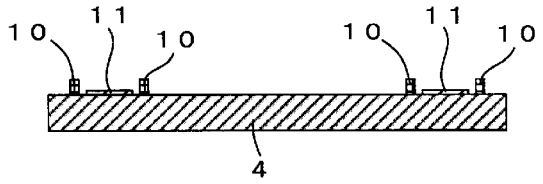
FIGS. 6A to 6E represent different steps.
Figure 6B:
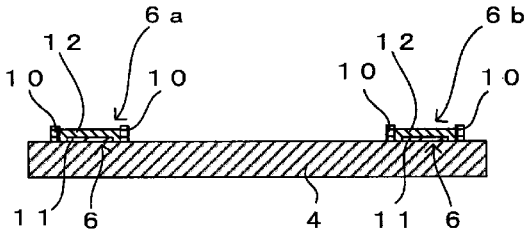

Initially, the second resin layer 4 (insulating layer) constituting a part of the insulator 2 is prepared, by way of example, as follows. First, as illustrated in FIG. 6A, the undercoating layer 11 of the second conductor 6, having the predetermined pattern shape and being in the form of a line, is formed on or in an upper surface of the second resin layer 4 (i.e., its surface opposing to the first resin layer 3) with a printing process using a conductive paste. Then, the dam member 10 is formed using resin, e.g., polyimide, around the undercoating layer 11 having the predetermined pattern shape and being in the form of a line. Then, as illustrated in FIG. 6B, the second conductor 6 (conductor) is formed by forming the plating layer 12 with a plating process to cover the undercoating layer 11 in a region of the upper surface of the second resin layer 4 on the inner side surrounded by the dam member 10, thus completing the second resin layer 4 (preparation step). The plating process is performed plural times as required in order to form plating films of different materials. The plating layer 12 is formed continuously from the first end portion 6*a* to the second end portion 6*b*.

Figure 6C:
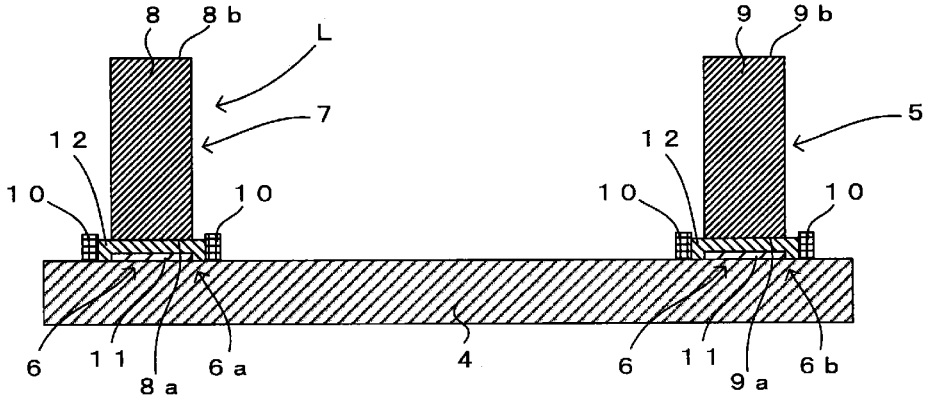

Then, as illustrated in FIG. 6C, the first end surface 8*a* of the first metal pin 8 is connected to the first end portion 6*a* of the second conductor 6, and the first end surface 9*a* of the second metal pin 9 is connected to the second end portion 6*b* of the second conductor 6, thereby forming the inductor electrode 7 of the inductor L (connection step). As in "1. One Example of Manufacturing Method" described above, in the connection step, the first conductor 5 and the second conductor 6 may be connected to each other with a bonding material, e.g., a solder. Alternatively, the first conductor 5 and the second conductor 6 may be connected to each other by utilizing ultrasonic vibration, for example.

Figure 6D:
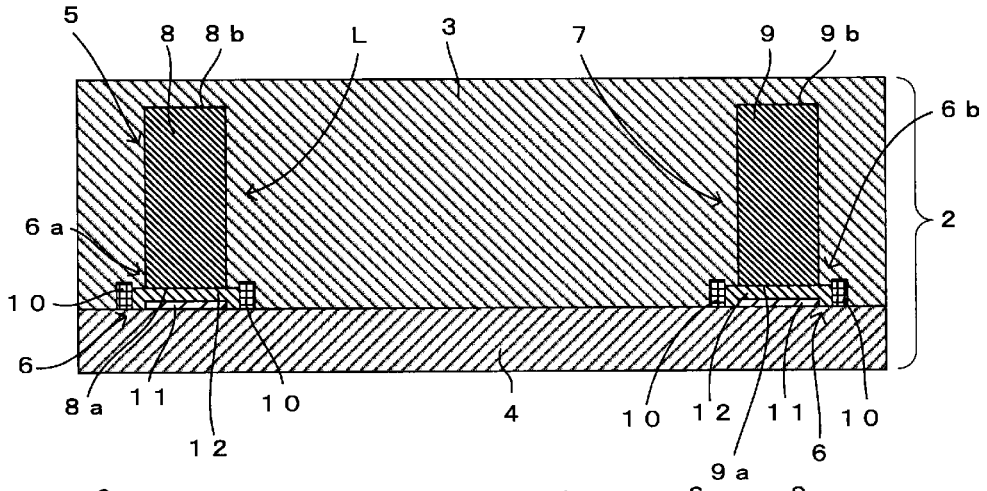
Figure 6E:
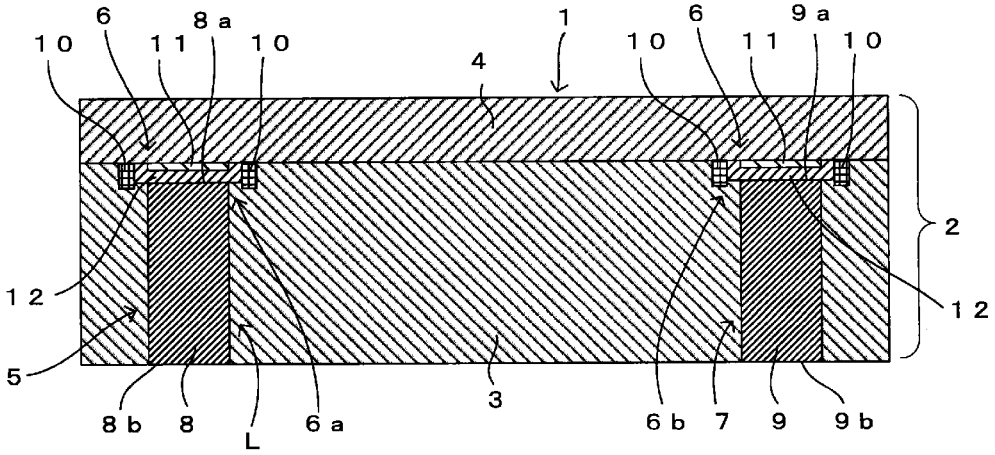

Then, as illustrated in FIG. 6D, a magnetic-substance containing resin constituting the remaining part of the insulator 2 is supplied onto the upper surface of the second resin layer 4, on which the second conductor 6 is formed, in a state of fully covering the first and second metal pins 8 and 9, thus forming the first resin layer 3 and hence the insulator 2 (formation step). Then, as illustrated in FIG. 6E, the resin on the surface of the first resin layer 3 is removed by polishing or grinding to make the second end surfaces 8*b* and 9*b* of the first and second metal pins 8 and 9 exposed at the surfaces of the first resin layer 3, whereby the inductor component 1 is completed.

As described above, the second conductor 6 being in the form of a line and being formed by coating the plating layer 12 over the undercoating layer 11, which is formed of the conductive paste, is formed on or in the surface of the second resin layer 4. The inductor electrode 7 is then formed by connecting the first end surface 8*a* of the first metal pin 8 to the plating layer 12 on the surface of the first end portion 6*a* of the second conductor 6, and by connecting the first end surface 9*a* of the second metal pin 9 to the plating layer 12 on the surface of the second end portion 6*b* of the second conductor 6. Accordingly, the inductor component 1 can be readily provided at a lower cost in which the resistance of the inductor electrode 7 is reduced with the feature that the respective first end surfaces 8*a* and 9*a* of the first and second metal pins 8 and 9 are directly connected to each other by the plating layer 12, which is formed continuously from the first end portion 6*a* connected to the first end surface 8*a* up to the second end portion 6*b* connected to the first end surface 9*a*, without interposition of the undercoating layer 11 of the second conductor 6 therebetween.

Furthermore, according to the manufacturing method illustrated in FIGS. 6A to 6E, after the first and second metal pins 8 and 9 constituting the first conductor 5 have been connected to the second conductor 6, heat treatment is performed only once in the step illustrated in FIG. 6D for the purpose of resin curing. It is hence possible to reduce thermal stress acting on the first and second metal pins 8 and 9, and to suppress the deterioration of the connection strength in a connecting portion between each of the first and second metal pins 8 and 9 and the second conductor 6.

According to this embodiment, as described above, the first conductor 5 constituting a part of the inductor electrode 7 is formed by the first and second metal pins 8 and 9 both buried in the first resin layer 3, and the respective first end surfaces 8*a* and 9*a* of the first and second metal pins 8 and 9 are exposed at the surface of the first resin layer 3 on the side opposing to the second resin layer 4. Moreover, the respective first end surfaces 8*a* and 9*a* of the first and second metal pins 8 and 9 are connected to each other by the second conductor 6 in the form of a line, which is disposed on or in the surface of the second resin layer 4 on the side opposing to the first resin layer 3, and which constitutes the remaining part of the inductor electrode 7. Thus, the inductor electrode 7 is formed.

In this connection, the second conductor 6 is constituted by the undercoating layer 11 formed using the conductive paste, and by the plating layer 12 formed in a state covering the undercoating layer 11. Accordingly, the second conductor 6 constituting a part of the inductor electrode 7 can be formed at a lower cost. Furthermore, since the respective first end surfaces 8*a* and 9*a* of the first and second metal pins 8 and 9 are directly connected to each other by the plating layer 12 of the second conductor 6 without interposition of the undercoating layer 11 thereof between them, the resistance of the inductor electrode 7 can be reduced at a lower cost.

Moreover, since the respective first end surfaces 8*a* and 9*a* of the first and second metal pins 8 and 9 are directly connected to each other by the plating layer 12 of the second conductor 6, the connection strength between each of the respective first end surfaces 8*a* and 9*a* of the first and second metal pins 8 and 9 and the second conductor 6 (the plating layer 12) can be increased.

Since the first conductor 5 is formed by the first and second metal pins 8 and 9, the resistance of the first conductor 5 can be reduced in comparison with the case where the first conductor 5 is made of, e.g., a hardened conductive paste formed into a columnar shape, a plated metal material having grown into a predetermined columnar shape with plating, or a columnar sintered body of metal powder. As a result, the resistance of the inductor electrode 7 can be further reduced. Also, since the first conductor 5 is formed by the first and second metal pins 8 and 9, a very small inductance value required in an electronic circuit to which a high-frequency signal is input can be easily obtained with the above-described inductor component 1.

In addition, the inductor component 1 can be provided in a practical structure including the inductor L in which the respective second end surfaces 8*b* and 9*b* of the first and second metal pins 8 and 9 of the first conductor 5, those second end surfaces being exposed at the principal surface of the first resin layer 3 on the side oppositely away from the second resin layer 4, can be used as external connection terminals. Since a step of providing the external connection terminals is not needed, the structure of the inductor component 1 is simplified, and this point is also effective in improving reliability of the inductor component 1. Moreover, the inductor component 1 can be manufactured at a lower cost.

When the plating layer 12 is bonded to the respective first end surfaces 8*a* and 9*a* of the first and second metal pins 8 and 9 by utilizing ultrasonic vibration, the first and second metal pins 8 and 9 are connected only by the plating layer 12 without interposition of a bonding material, e.g., a solder. Accordingly, further reduction of the resistance of the inductor electrode 7 can be realized.

Second Embodiment

An inductor component according to a second embodiment of the present disclosure will be described below.

A basic structure of an inductor component 100 is described with reference to FIGS. 7A and 7B. For the sake of simplicity of explanation, in FIGS. 7A and 7B referenced in the following description, configurations of electrodes, etc. are schematically illustrated, and the first and second metal pins 8 and 9, the second conductors 6, and third conductors 102 are partly omitted from the drawing. Detailed description of the omitted parts is omitted in the following.

Figure 7A:
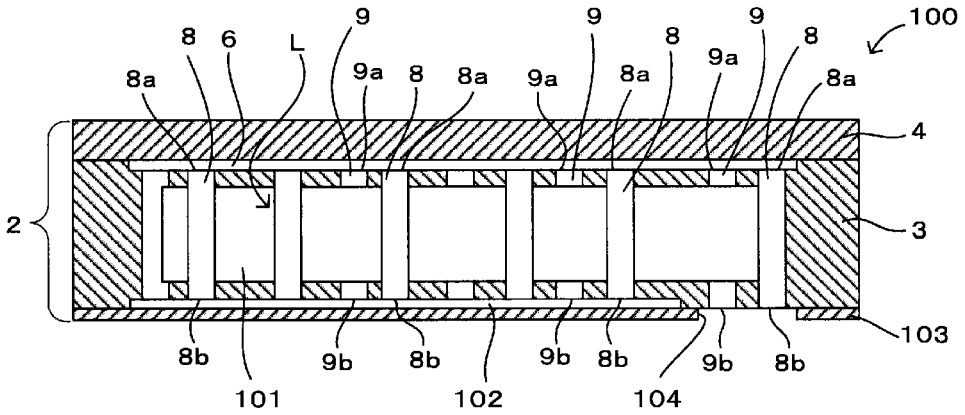
FIG. 7A is a partly sectioned view.
Figure 7B:
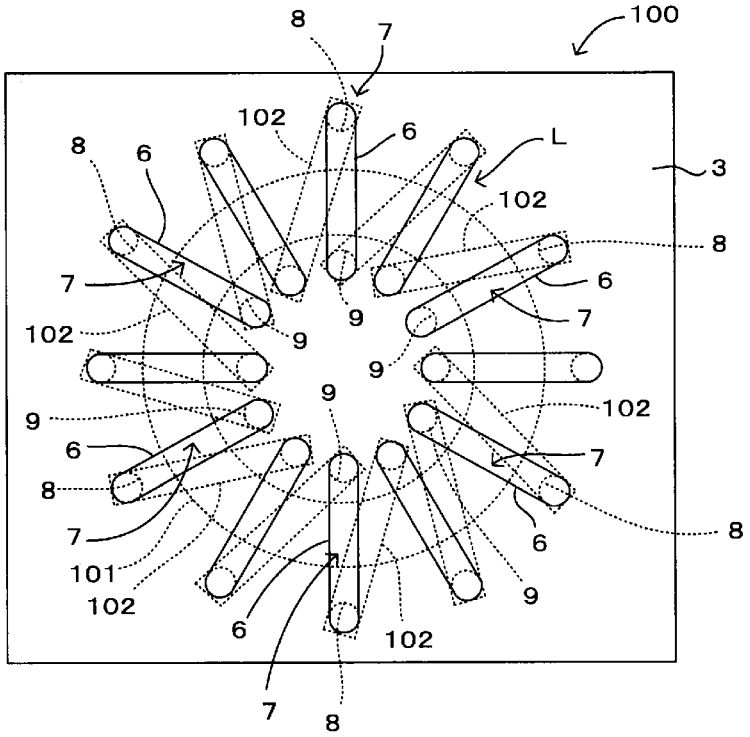
FIG. 7B is an explanatory view referenced to explain a connection state of first and second metal pins that form an inductor electrode.

The inductor component 100 of this embodiment is different from the inductor component 1 illustrated in FIG. 1 in that, as illustrated in FIGS. 7A and 7B, the inductor component 100 includes a coil core 101 disposed between the first and second metal pins 8 and 9 in a state buried in the first resin layer 3. The following description is made mainly about different points in comparison with the above first embodiment, and similar constituent members to those in the above first embodiment are denoted by the same reference signs while description of those constituent members is omitted.

As illustrated in FIGS. 7A and 7B, the coil core 101 has an annular shape, and the plurality of inductor electrodes 7 are arrayed along a circumferential direction of the coil core 101 in such a state that the first metal pins 8 are arranged on the outer peripheral side of the coil core 101, that the second metal pins 9 are arranged on the inner peripheral side of the coil core 101, and that the respective first end surfaces 8*a* and 9*a* of the first and second metal pins 8 and 9 are connected to each other by the second conductor 6. Furthermore, the second end surface 8*b* of the first metal pin 8 of one inductor electrode 7 and the second end surface 9*b* of the second metal pin 9 of another inductor electrode 7, which is positioned adjacent to the one inductor electrode 7 on the predetermined side ("counterclockwise side" in this embodiment), are connected to each other by one of the plurality of third conductors 102 each being in the form of a line. Thus, in the inductor component 100, an inductor L formed by the plurality of inductor electrodes 7, which are arranged to spirally extend around the coil core 101, is disposed inside the insulator 2.

Each of the third conductors 102 is formed, as with the above-described second conductor 6, on a principal surface of a third resin layer 103 on the side opposing to the first resin layer 3, the third resin layer 103 being disposed on the lower surface side of the first resin layer 3. More specifically, though not illustrated, the third conductor 102 is formed by an undercoating layer, and a plating layer covering the undercoating layer. The corresponding second end surfaces 8*b* and 9*b* of the first and second metal pins 8 and 9 are directly connected to each other by the plating layer 12 of the third conductor 102 without interposition of the undercoating layer thereof between them.

In this embodiment, an opening 104 is formed in a predetermined region of the third resin layer 103. External connection terminals of the inductor component 100 are formed at a position of the opening 104 by the respective second end surfaces 8*b* and 9*b* of the first and second metal pins 8 and 9, which are exposed at the surface of the first resin layer 3. Furthermore, in this embodiment, the insulator 2 does not contain magnetic filler, and it is formed of a general thermosetting resin, e.g., an epoxy resin. As in the above-described first embodiment, the material of the insulator 2 is not limited to the thermosetting resin, e.g., the epoxy resin.

The inductor component 100 can be manufactured in accordance with any of the manufacturing methods described above with reference to FIGS. 4A to 6E. In accordance with the manufacturing method illustrated in FIGS. 4A to 4G, for example, in the step illustrated in FIG. 4A, the plurality of first conductors 5 may be arrayed on the coupling plate 20 along a predetermined region where the coil core 101 is disposed, such that the first and second metal pins 8 and 9 sandwich the predetermined region. After disposing the coil core 101 in the predetermined region, the first resin layer 3 may be formed in the step illustrated in FIG. 4B. In accordance with the manufacturing method illustrated in FIGS. 5A to 5G, for example, in the step illustrated in FIG. 5A, a predetermined region having substantially the same shape as the coil core 101 when viewed from above may be set on the transfer plate 30, and the plurality of first conductors 5 may be arrayed along the predetermined region such that the first and second metal pins 8 and 9 sandwich the predetermined region. Then, in the step illustrated in FIG. 5B, the individual first conductors 5 may be transferred from the transfer plate 30 onto the release sheet 40, and in the step illustrated in FIG. 5C, the first resin layer 3 may be formed after removing the transfer plate 30 and arranging the coil core 101 between the first and second metal pins 8 and 9.

In accordance with the manufacturing method illustrated in FIGS. 6A to 6E, for example, in the steps illustrated in FIG. 6A and 6B, the plurality of second conductors 6 may be formed on the second resin layer 4in a bridging relation across a predetermined region where the coil core 101 is disposed. Then, in the step illustrated in FIG. 6C, the first and second metal pins 8 and 9 may be connected to each of the second conductors 6. After disposing the coil core 101 in the predetermined region, the first resin layer 3 may be formed in the step illustrated in FIG. 6D.

In the final step in each of the manufacturing methods described with reference to FIGS. 4A to 6E, the third resin layer 103 including the plurality of third conductors 102 formed thereon may be laminated on the first resin layer 3, and the corresponding second end surfaces 8*b* and 9*b* of the first and second metal pins 8 and 9 may be connected to each other by the third conductor 102.

(Modifications of Coil Core)

Figure 8A:
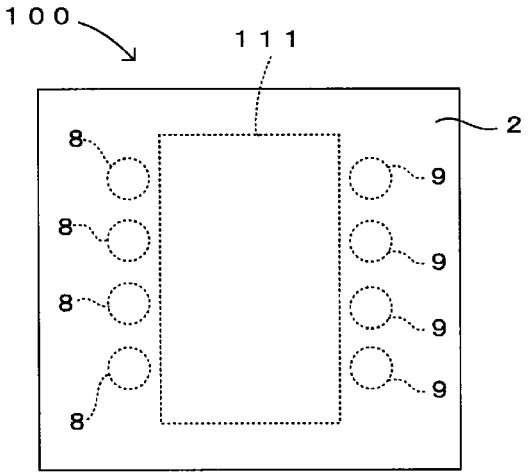
FIG. 8A illustrates a coil core having a linear shape.
Figure 8B:
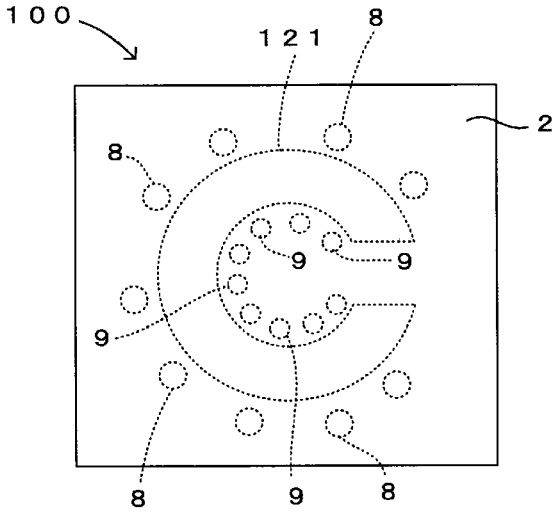
FIG. 8B illustrates a coil core having a substantially C-shape.

While the above description has been made, by way of example, in connection with the case of employing the coil core 101 of annular toroidal type, the shape of the coil core is not limited to the toroidal type. Coil cores having various shapes may be optionally used, including a coil core 111 having a linear shape as illustrated in FIG. 8A, and a coil core 121 having a substantially C-shape as illustrated in FIG. 8B. Each of FIGS. 8A and 8B illustrates modifications of the coil core, and represents positional relations between each of the coil cores 111 and 121 and the first and second metal pins 8 and 9 inside the insulator 2. FIG. 8A illustrates the linear coil core, and FIG. 8B illustrates the substantially C-shaped coil core.

According to this embodiment, as described above, since the coil core 101, 111 or 121 is disposed between the first and second metal pins 8 and 9, the inductance of the inductor L included in the inductor component 100 can be increased. Furthermore, coils having various functions, such as a common mode noise filter and a choke coil, can be constituted by utilizing the inductor electrodes 7 included in the inductor component 100.

Third Embodiment

An inductor component according to a third embodiment of the present disclosure will be described below.

Figure 9:
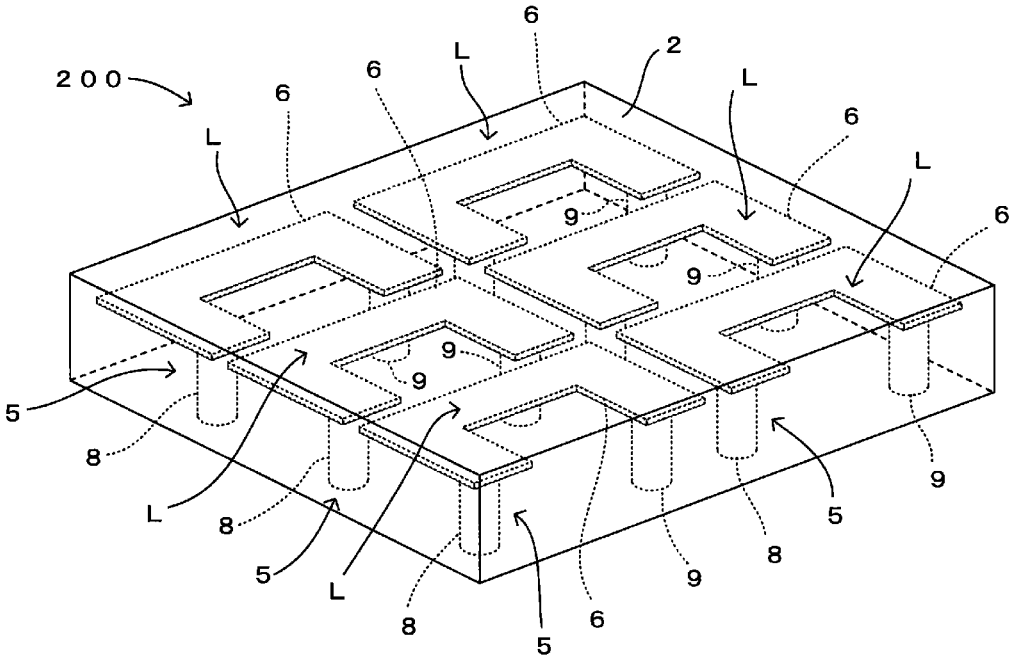
FIG. 9 is a perspective view of an inductor component according to a third embodiment of the present disclosure.

A basic structure of an inductor component 200 is described with reference to FIG. 9. The inductor component 200 (inductor array) of this embodiment is different from the inductor component 1 illustrated in FIG. 1 in that, as illustrated in FIG. 9, a plurality (six in the illustrated embodiment) of inductors L are disposed in the form of an array within the insulator 2 so as to provide the plurality of inductors L as an integral unit. The inductor component 200 can be manufactured in accordance with any of the manufacturing methods described above with reference to FIGS. 4A to 6E. Detailed description of the manufacturing methods for the inductor component 200 is omitted here. Because other configurations of the individual constituent members are similar to those in the above first embodiment, those constituent members are denoted by the same reference signs, and description of those constituent members is omitted here.

Fourth Embodiment

An inductor component and a manufacturing method for the inductor component, according to a fourth embodiment of the present disclosure, will be described below.

(Structure of Inductor Component)

A structure of the inductor component is described with reference to FIGS. 10A, 10B and 10C, and 11. The fourth embodiment is different from the first embodiment in that the respective first end surfaces 8*a* and 9*a* of the first and second metal pins 8 and 9 are exposed at one principal surface 3*a* of the first resin layer 3 on the side opposing to the second resin layer 4, and that respective end portions of the first and second metal pins 8 and 9 on the same side as the first end surfaces 8*a* and 9*a* are each formed in a tapered shape gradually thinning toward a tip end. The following description is made mainly about different points in comparison with the above first embodiment, and similar constituent members are denoted by the same reference signs while description of those constituent members is omitted.

In this embodiment, the plating layer 12 is formed by the Cu layer 12*a* covering the undercoating layer 11, the Ni layer 12*b* formed on or in the surface of the Cu layer 12*a*, and the Au layer 12*c* formed on or in the surface of the Ni layer 12*b* (note that 12*c* may be a Sn layer). Furthermore, in this embodiment, ultrasonic vibration is utilized to perform ultrasonic bonding between the plating layer 12 in the first end portion 6*a* of the second conductor 6 and the first end surface 8*a* of the first metal pin 8, and ultrasonic bonding between the plating layer 12 in the second end portion 6*b* of the second conductor 6 and the first end surface 9*a* of the second metal pin 9. As a result, the respective first end surfaces 8*a* and 9*a* of the first and second metal pins 8 and 9 are connected to each other by the second conductor 6.

Figure 11:
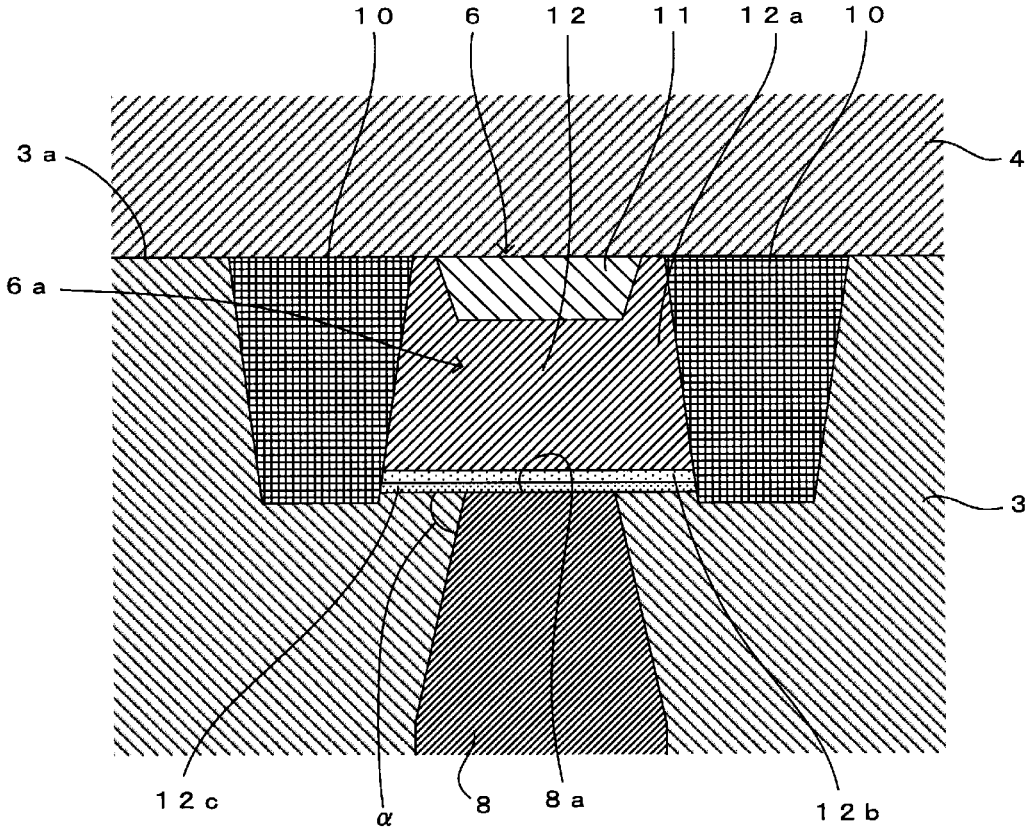
FIG. 11 is a partial enlarged view of a region in FIG. 10B, the region surrounded by a dotted line.

Moreover, in this embodiment, as illustrated in FIG. 11, the plating layer 12 in the first end portion 6*a* of the second conductor 6 is formed in a width larger than a maximum width of the first end surface 8*a* of the first metal pin 8, and the plating layer 12 in the second end portion 6*b* of the second conductor 6 is formed in a width larger than a maximum width of the first end surface 9*a* of the second metal pin 9, as in the inductor component 1 illustrated in FIG. 3A. Accordingly, it is possible to improve reliability of the connection between the plating layer 12 in the first end portion 6*a* of the second conductor 6 and the first end surface 8*a* of the first metal pin 8, and to improve reliability of the connection between the plating layer 12 in the second end portion 6*b* of the second conductor 6 and the first end surface 9*a* of the second metal pin 9.

In addition, the respective end portions of the first and second metal pins 8 and 9 on the same side as the first end surfaces 8*a* and 9*a* are each formed in the tapered shape. Accordingly, as illustrated in FIG. 11 taking the first metal pin 8 as an example, an angle $\alpha$ formed between a peripheral surface of each of the end portions of the first and second metal pins 8 and 9 on the same side as the first end surfaces 8*a* and 9*a*, which are connected to the second conductor 6 (specifically, to the plating layer 12), and the surface of the second conductor 6 is set to an acute angle larger than 0° and smaller than 90°. For example, in the case of a large current flowing through the inductor electrode 7, connected portions of the first conductor 5 and the second conductor 6 tend to be heated more intensively. However, when the first and second metal pins 8 and 9 are expanded with the heating up to high temperature, the respective end portions of the first and second metal pins 8 and 9 on the same side as the first end surfaces 8*a* and 9*a* are expanded in such a way that the peripheral surfaces of those end portions are bulged toward the first end surfaces 8*a* and 9*a*, i.e., toward the second conductor 6 to which the first end surfaces 8*a* and 9*a* are connected.

Thus, because stresses are generated in directions of pressing, toward the second conductor 6, the resins covering the peripheral surfaces of the respective end portions of the first and second metal pins 8 and 9 on the same side as the first end surfaces 8*a* and 9*a*, slippage can be prevented from occurring between the one principal surface 3*a* of the first resin layer 3 and the second conductor 6 (specifically, the plating layer 12) near the respective first end surfaces 8*a* and 9*a* of the first and second metal pins 8 and 9. As a result, the inductor component 1 can be provided in which the second conductor 6 of the inductor electrode 7 is prevented from peeling off from the surface (one principal surface 3*a*) of the first resin layer 3.

Moreover, in this embodiment, since the first conductor 5 and the second conductor 6 are directly connected to each other by utilizing ultrasonic vibration, the inductor component 1 can be provided which includes the inductor electrode 7 having good electrical characteristics, and which has high reliability with no risk of a drawback such as solder flash.

(Manufacturing Method for Inductor Component)

A manufacturing method for the inductor component will be described below. For the sake of easiness in explanation, the following description is made in connection with an example of manufacturing one inductor component 1. The plurality of inductor components 1 may be manufactured at the same time by forming the plurality of inductor components 1 together in accordance with the manufacturing method described below, and then dividing the plurality of inductor components 1 in the integral form into individual pieces.

4. One Example of Manufacturing Method

One example of the manufacturing method is described with reference to FIGS. 12A to 12F.

Figure 12A:
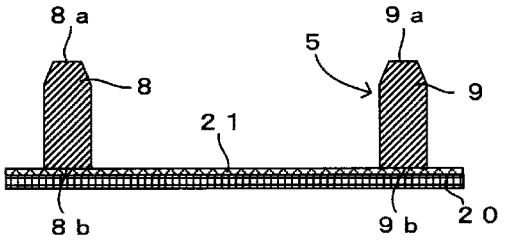
FIGS. 12A to 12F represent different steps.
Figure 12D:
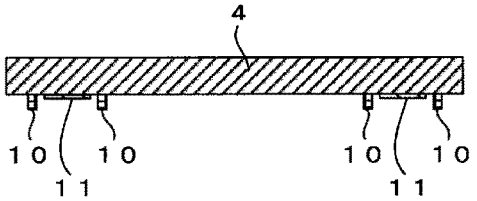
Figure 12B:
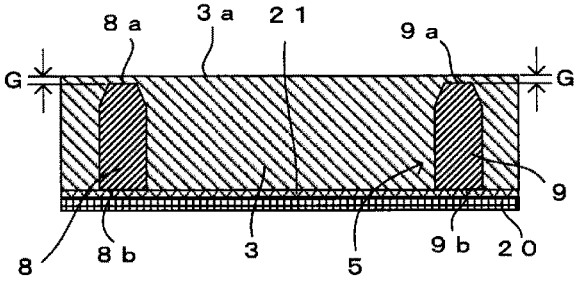

First, as illustrated in FIG. 12A, a coupling plate 20 including an adhesive layer 21 formed on or in one principal surface thereof is prepared, and the first and second metal pins 8 and 9 having the tapered end portions on the same side as the first end surfaces 8*a* and 9*a* are prepared. Then, the first and second metal pins 8 and 9 are vertically disposed on the one principal surface of the coupling plate 20 at predetermined positions by attaching, to the adhesive layer 21, the respective second end surfaces 8*b* and 9*b* of the first and second metal pins 8 and 9 that constitute the first conductor 5. Then, as illustrated in FIG. 12B, the first and second metal pins 8 and 9 are covered with a magnetic-substance containing resin in such a state that the respective first end surfaces 8*a* and 9*a* of the first and second metal pins 8 and 9 are opposed to the one principal surface 3*a* of the first resin layer 3 with a predetermined distance G held therebetween. Then, the first resin layer 3 constituting a part of the insulator 2 is prepared by thermally curing the resin and forming the first resin layer 3 in which the first and second metal pins 8 and 9 are buried (preparation step). On that occasion, a thickness (distance G) of a surface layer portion of the first resin layer 3, which portion is positioned on the side nearer to the surface of the first resin layer 3 than each of the respective first end surfaces 8*a* and 9*a* of the first and second metal pins 8 and 9, is set to a value by which the first resin layer 3 is to be fractured in a press connection step described later.

Figure 12E:
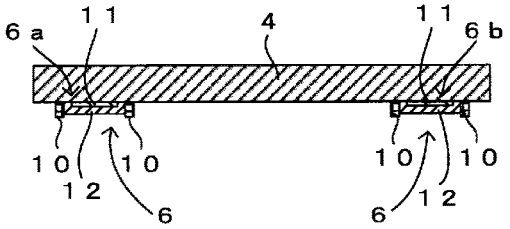
Figure 12C:
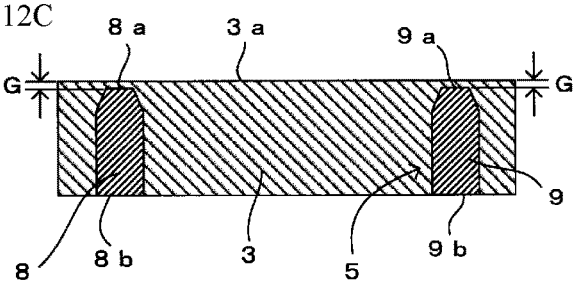

Then, as illustrated in FIG. 12C, the coupling plate 20 is peeled off and removed from the first resin layer 3 (peeling-off step). It is to be noted that, in the manufacturing method of this example, the step illustrated in FIG. 12C may be executed after a later-described step illustrated in FIG. 12F.

Then, the second resin layer 4 constituting the remaining part of the insulator 2 is prepared, by way of example, as follows. First, as illustrated in FIG. 12D, the undercoating layer 11 of the second conductor 6, having a predetermined pattern shape and being in the form of a line, is formed on or in the lower surface of the second resin layer 4 (i.e., its surface opposing to the first resin layer 3) with a printing process using a conductive paste. Then, the dam member 10 is formed using resin, e.g., polyimide, around the undercoating layer 11 having the predetermined pattern shape and being in the form of a line. Then, as illustrated in FIG. 12E, the second conductor 6 is formed by forming the plating layer 12 with a plating process to cover the undercoating layer 11 in a region of the lower surface of the second resin layer 4 on the inner side surrounded by the dam member 10, thus completing the second resin layer 4 (second resin layer forming step). The plating process is performed plural times as required in order to form plating films of different materials.

Figure 12F:
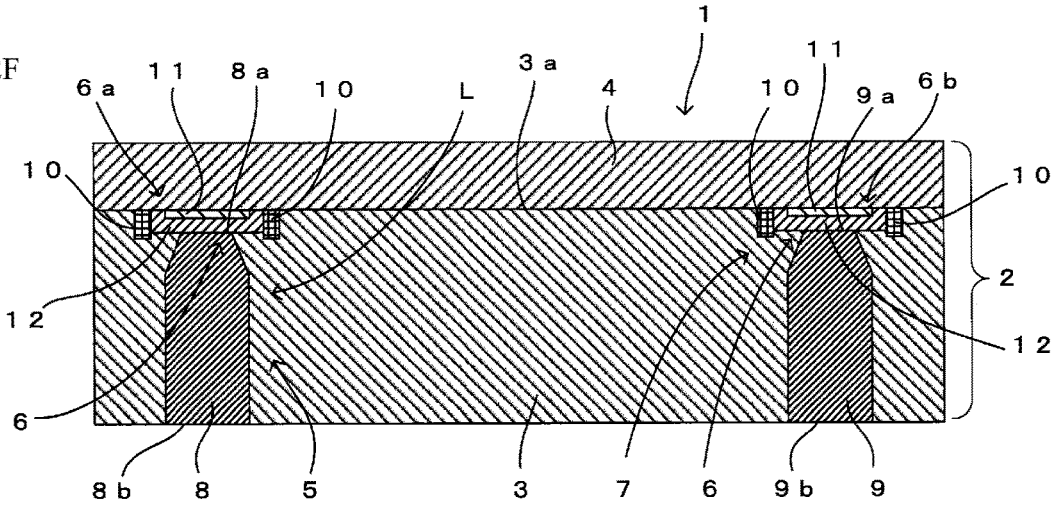

Then, as illustrated in FIG. 12F, the second resin layer 4 is overlaid on the one principal surface 3*a* of the first resin layer 3 in a state of sandwiching, between the second resin layer 4 and the first resin layer 3, the second conductor 6 that is formed on or in the lower surface of the second resin layer 4 to interconnect the respective first end surfaces 8*a* and 9*a* of the first and second metal pins 8 and 9 (second resin layer overlaying step). Then, the first resin layer 3 and the second resin layer 4 are pressed against each other in an overlaying direction under application of ultrasonic vibration in a way of fracturing the surface layer portion of the first resin layer 3 on the side nearer to the one principal surface 3*a* thereof between each of the respective first end surfaces 8*a* and 9*a* of the first and second metal pins 8 and 9 and the second conductor 6. By fracturing the surface layer portion of the first resin layer 3 so as to partly pierce the first resin layer 3 until reaching the end portions of the first and second metal pins 8 and 9 on the same side as the first end surfaces 8*a* and 9*a*, the first end surface 8*a* of the first metal pin 8 penetrating the first resin layer 3 is connected to the first end portion 6*a* of the second conductor 6, and the first end surface 9*a* of the second metal pin 9 penetrating the first resin layer 3 is connected to the second end portion 6*b* of the second conductor 6, whereby the inductor electrode 7 of the inductor L is formed (press connection step). As a result, the inductor component 1 is completed.

As described above, the plating layer 12 on the surface of the first end portion 6*a* of the second conductor 6 is connected to the first end surface 8*a* of the first metal pin 8, and the plating layer 12 on the surface of the second end portion 6*b* of the second conductor 6 is connected to the first end surface 9*a* of the second metal pin 9, whereby the inductor electrode 7 is formed. Accordingly, the inductor electrode 7 can be obtained in which the resistance is reduced with the feature that the respective first end surfaces 8*a* and 9*a* of the first and second metal pins 8 and 9 are directly connected to each other by the plating layer 12 of the second conductor 6 without interposition of the undercoating layer 11 thereof between them.

Which ones of the steps illustrated in FIGS. 12A to 12C and the steps illustrated in FIGS. 12D and 12E are to be executed first is optionally selectable. As an alternative, those steps may be executed at the same time. Stated in another way, it is just required that the inductor component 1 can be formed by finally laminating the first resin layer 3 and the second resin layer 4, which have been prepared separately.

5. Another Example of Manufacturing Method

Another example of the manufacturing method is described with reference to FIGS. 13A to 13G.

Figure 13A:
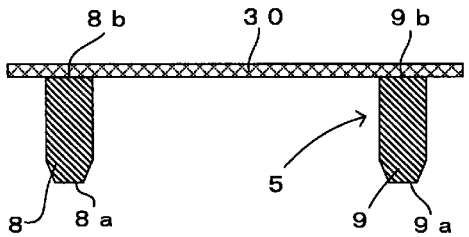
FIGS. 13A to 13G represent different steps.

First, as illustrated in FIG. 13A, a transfer plate 30 is prepared which supports, at one principal surface thereof, the respective second end surfaces 8*b* and 9*b* of the first and second metal pins 8 and 9 both constituting the first conductor 5, and the first and second metal pins 8 and 9 having the tapered end portions on the same side as the first end surfaces 8*a* and 9*a* are also prepared. An adhesive layer (not illustrated) is formed on or in the one principal surface of the transfer plate 30 to be able to support the respective second end surfaces 8*b* and 9*b* of the first and second metal pins 8 and 9. The first and second metal pins 8 and 9 constituting the first conductor 5 are supported to the one principal surface of the transfer plate 30 by attaching the respective second end surfaces 8*b* and 9*b* of the first and second metal pins 8 and 9 to the one principal surface of the transfer plate 30 in such a state that the first and second metal pins 8 and 9 are positioned with a spacing therebetween at which the inductor L of the inductor component 1 can exhibit the desired inductance.

Figure 13D:
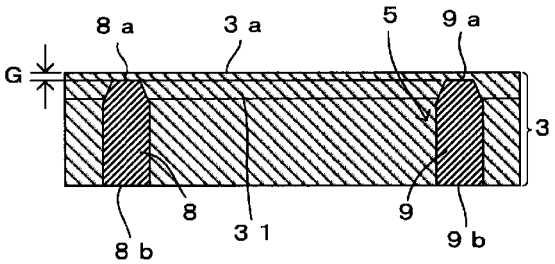
Figure 13B:
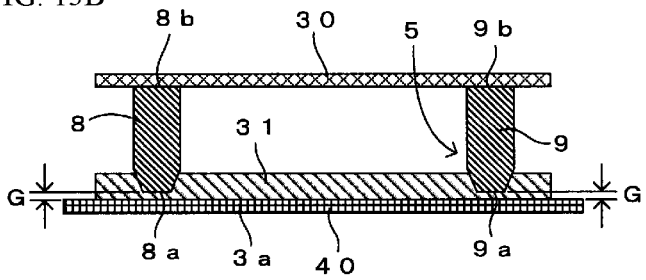

Then, as illustrated in FIG. 13B, a release sheet 40 is prepared. On one principal surface of the release sheet 40, a support layer 31 constituting a part of the first resin layer 3 and being in a not-yet-cured state is formed by coating the one principal surface with a magnetic-substance containing resin in a thickness of about 50 to 100 μm, for example. Alternatively, the support layer 31 may be formed by placing a resin sheet, which has been separately fabricated, on the release sheet 40. The release sheet 40 can be prepared by forming a release layer on a resin sheet made of, e.g., polyethylene terephthalate, polyethylene naphthalate, or polyimide, or by employing a resin sheet that has the release function in itself, such as a fluorine resin sheet.

Then, the first and second metal pins 8 and 9 supported by the transfer plate 30 are vertically disposed on the one principal surface of the release sheet 40 at predetermined positions by causing the respective end portions of the first and second metal pins 8 and 9 on the same side as the first end surfaces 8*a* and 9*a* to enter the support layer 31 such that the respective first end surfaces 8*a* and 9*a* of the first and second metal pins 8 and 9 are each opposed to the one principal surface 3*a* of the first resin layer 3 (i.e., the one principal surface of the release sheet 40) with the predetermined distance G held therebetween. Then, the support layer 31 is thermally cured. With the thermal curing of the support layer 31, the respective end portions of the first and second metal pins 8 and 9 on the same side as the first end surfaces 8*a* and 9*a* are supported by the support layer 31.

When the not-yet-cured support layer 31 is thermally cured, the magnetic-substance containing resin forming the support layer 31 is preferably caused to rise with wetting properties over outer peripheral surfaces of the respective end portions of the first and second metal pins 8 and 9 on the same side as the first end surfaces 8*a* and 9*a*. With such a feature, a support (not illustrated) formed by the magnetic-substance containing resin, which has risen in the form of a fillet over each of the outer peripheral surfaces of the respective end portions of the first and second metal pins 8 and 9 on the same side as the first end surfaces 8*a* and 9*a*, is formed integrally with the support layer 31 after being cured. Hence strength in supporting the first and second metal pins 8 and 9 by the cured support layer 31 can be increased.

The shape of the fillet-like support can be adjusted by changing the type or the amount of the magnetic-substance containing resin that forms the first resin layer 3 (i.e., the insulator 2), or by surface-treating the first and second metal pins 8 and 9 and adjusting their wetting properties.

Figure 13E:
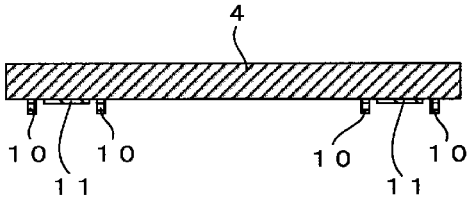
Figure 13C:
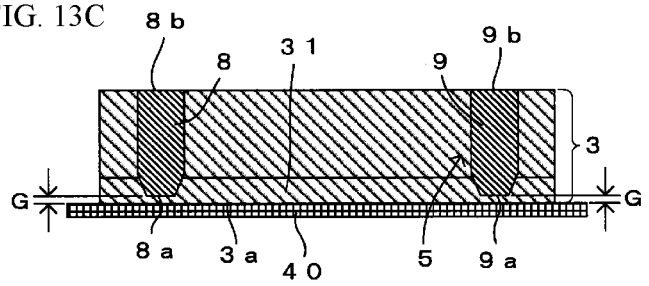

Then, as illustrated in FIG. 13C, the transfer plate 30 is removed, and the same magnetic-substance containing resin as that used to form the support layer 31 is supplied onto the support layer 31, thus forming the first resin layer 3 to cover the first and second metal pins 8 and 9 in such a state that the second end surfaces 8*b* and 9*b* are exposed at the surface of the first resin layer 3. The first resin layer 3 constituting a part of the insulator 2 is thus prepared (preparation step). Then, as illustrated in FIG. 13D, the release sheet 40 is peeled off and removed (peeling-off step). On that occasion, a thickness (distance G) of a surface layer portion of the first resin layer 3, which portion is positioned on the side nearer to the surface of the first resin layer 3 than each of the respective first end surfaces 8*a* and 9*a* of the first and second metal pins 8 and 9, is set to a value by which the first resin layer 3 is to be fractured in a press connection step described later.

The first resin layer 3 may be formed by forming the support layer 31 with use of the magnetic-substance containing resin in a liquid state, and by arranging the magnetic-substance containing resin on the support layer 31. The support layer 31 and a resin layer formed on the support layer 31 may be formed using different types of magnetic-substance containing resins. Here, the different types of magnetic-substance containing resins imply resins in which the contents of magnetic fillers are the same, but the types thereof are different, resins in which the types of magnetic fillers are the same, but the contents thereof are different, resins in which the contents and the types of magnetic fillers are both different, or resins in which the types of insulating resins are different.

Figure 13F:
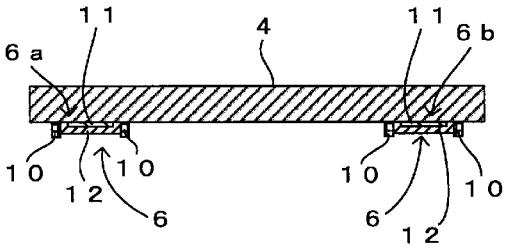

Then, the second resin layer 4 constituting the remaining part of the insulator 2 is prepared, by way of example, as follows. First, as illustrated in FIG. 13E, the undercoating layer 11 of the second conductor 6, having the predetermined pattern shape and being in the form of a line, is formed on or in the lower surface of the second resin layer 4 (i.e., its surface opposing to the first resin layer 3) with a printing process using a conductive paste. Then, the dam member 10 is formed using resin, e.g., polyimide, around the undercoating layer 11 having the predetermined pattern shape and being in the form of a line. Then, as illustrated in FIG. 13F, the second conductor 6 is formed by forming the plating layer 12 with a plating process to cover the undercoating layer 11 in a region of the lower surface of the second resin layer 4 on the inner side surrounded by the dam member 10, thus completing the second resin layer 4 (second resin layer forming step). The plating process is performed plural times as required in order to form plating films of different materials.

Figure 13G:
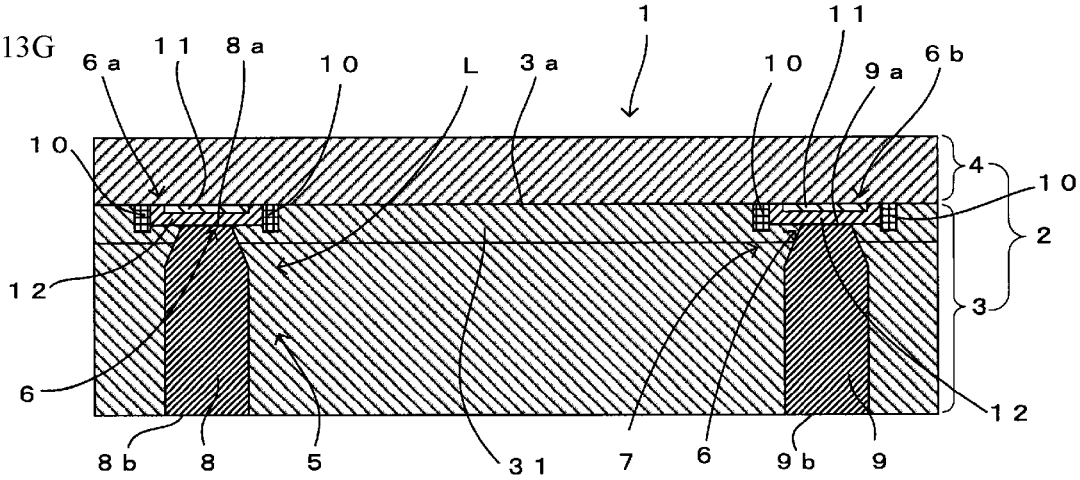

Then, as illustrated in FIG. 13G, the second resin layer 4 is overlaid on the one principal surface 3*a* of the first resin layer 3 in a state of sandwiching, between the second resin layer 4 and the first resin layer 3, the second conductor 6 that is formed on or in the lower surface of the second resin layer 4 to interconnect the respective first end surfaces 8*a* and 9*a* of the first and second metal pins 8 and 9 (second resin layer overlaying step). Then, the first resin layer 3 and the second resin layer 4 are pressed against each other in an overlaying direction under application of ultrasonic vibration in a way of fracturing the surface layer portion of the first resin layer 3 on the side nearer to the one principal surface 3*a* thereof between each of the respective first end surfaces 8*a* and 9*a* of the first and second metal pins 8 and 9 and the second conductor 6. Thus, the first end surface 8*a* of the first metal pin 8 is connected to the first end portion 6*a* of the second conductor 6, and the first end surface 9*a* of the second metal pin 9 is connected to the second end portion 6*b* of the second conductor 6, whereby the inductor electrode 7 of the inductor L is formed (press connection step). As a result, the inductor component 1 is completed.

As in "4. One Example of Manufacturing Method" described above, which ones of the steps illustrated in FIGS. 13A to 13D and the steps illustrated in FIGS. 13E and 13F are to be executed first is optionally selectable. As an alternative, those steps may be executed at the same time. Stated in another way, it is just required that the inductor component 1 can be formed by finally laminating the first resin layer 3 and the second resin layer 4, which have been prepared separately.

Thus, as in "4. One Example of Manufacturing Method" described above, the inductor electrode 7 can be obtained in which the resistance is reduced with the feature that the respective first end surfaces 8*a* and 9*a* of the first and second metal pins 8 and 9 are directly connected to each other by the plating layer 12 of the second conductor 6 without interposition of the undercoating layer 11 thereof between them.

6. Still Another Example of Manufacturing Method

Still another example of the manufacturing method is described with reference to FIGS. 14A to 14G.

Figure 14A:
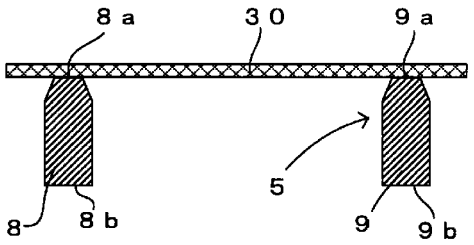
FIGS. 14A to 14G represent different steps.

First, as illustrated in FIG. 14A, a transfer plate 30 is prepared which supports, at one principal surface thereof, the respective first end surfaces 8*a* and 9*a* of the first and second metal pins 8 and 9 both constituting the first conductor 5, and the first and second metal pins 8 and 9 having the tapered end portions on the same side as the first end surfaces 8*a* and 9*a* are also prepared. An adhesive layer (not illustrated) is formed on or in the one principal surface of the transfer plate 30 to be able to support the respective first end surfaces 8*a* and 9*a* of the first and second metal pins 8 and 9. The first and second metal pins 8 and 9 constituting the first conductor 5 are supported to the one principal surface of the transfer plate 30 by attaching the respective first end surfaces 8*ab* and 9*a* of the first and second metal pins 8 and 9 to the one principal surface of the transfer plate 30 in such a state that the first and second metal pins 8 and 9 are positioned with a spacing therebetween at which the inductor L of the inductor component 1 can exhibit the desired inductance.

Figure 14D:
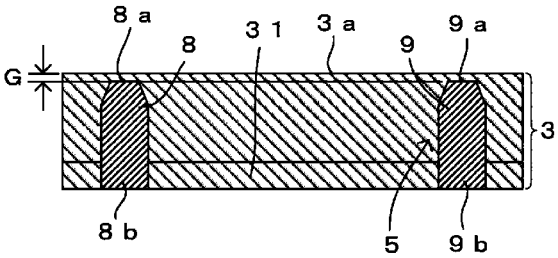
Figure 14B:
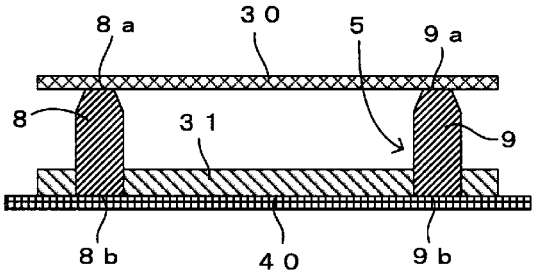

Then, as illustrated in FIG. 14B, a release sheet 40 is prepared. On one principal surface of the release sheet 40, a support layer 31 constituting a part of the first resin layer 3 and being in a not-yet-cured state is formed by coating the one principal surface with a magnetic-substance containing resin in a thickness of about 50 to 100 μm, for example. Alternatively, the support layer 31 may be formed by placing a resin sheet, which has been separately fabricated, on the release sheet 40. The release sheet 40 can be prepared by forming a release layer on a resin sheet made of, e.g., polyethylene terephthalate, polyethylene naphthalate, or polyimide, or by employing a resin sheet that has the release function in itself, such as a fluorine resin sheet.

Then, the first and second metal pins 8 and 9 are vertically disposed on the one principal surface of the release sheet 40 at predetermined positions by causing the respective end portions of the first and second metal pins 8 and 9, both supported by the transfer plate 30, on the same side as the second end surfaces 8*b* and 9*b* until the second end surfaces 8*b* and 9*b* penetrate the support layer 31 and come into contact with the release sheet 40. Then, the support layer 31 is thermally cured. With the thermal curing of the support layer 31, the respective end portions of the first and second metal pins 8 and 9 on the same side as the second end surfaces 8*b* and 9*b* are supported by the support layer 31.

When the not-yet-cured support layer 31 is thermally cured, the magnetic-substance containing resin forming the support layer 31 is preferably caused to rise with wetting properties over outer peripheral surfaces of the respective end portions of the first and second metal pins 8 and 9 on the same side as the second end surfaces 8*b* and 9*b*. With such a feature, a support (not illustrated) formed by the magnetic-substance containing resin, which has risen in the form of a fillet over each of the outer peripheral surfaces of the respective end portions of the first and second metal pins 8 and 9 on the same side as the second end surfaces 8*b* and 9*b*, is formed integrally with the support layer 31 after being cured. Hence strength in supporting the first and second metal pins 8 and 9 by the cured support layer 31 can be increased.

The shape of the fillet-like support can be adjusted by changing the type or the amount of the magnetic-substance containing resin that forms the first resin layer 3 (i.e., the insulator 2), or by surface-treating the first and second metal pins 8 and 9 and adjusting their wetting properties.

Figure 14E:
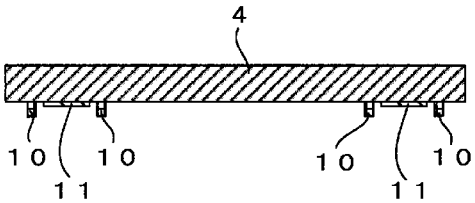
Figure 14C:
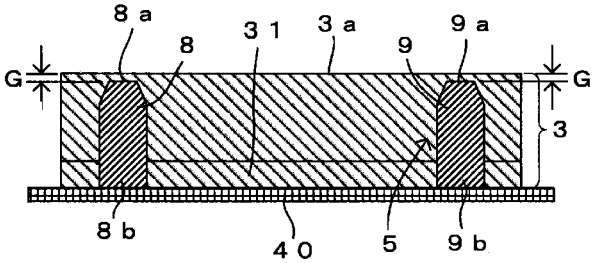

Then, as illustrated in FIG. 14C, the transfer plate 30 is removed, and the first and second metal pins 8 and 9 are covered with the magnetic-substance containing resin in such a state that the respective first end surfaces 8*a* and 9*a* of the first and second metal pins 8 and 9 are opposed to the one principal surface 3*a* of the first resin layer 3 with a predetermined distance G held therebetween. The first resin layer 3 constituting a part of the insulator 2 is prepared by thermally curing the resin and forming the first resin layer 3 in which the first and second metal pins 8 and 9 are buried (preparation step). Then, as illustrated in FIG. 14D, the release sheet 40 is peeled off and removed (peeling-off step). On that occasion, a thickness (distance G) of a surface layer portion of the first resin layer 3, which portion is positioned on the side nearer to the surface of the first resin layer 3 than each of the respective first end surfaces 8*a* and 9*a* of the first and second metal pins 8 and 9, is set to a value by which the first resin layer 3 is to be fractured in a press connection step described later. In the manufacturing method of this example, the step illustrated in FIG. 14D may be executed after a later-described step illustrated in FIG. 14G. The first resin layer 3 may be formed in accordance with a method similar to that described above with reference to FIGS. 13A to 13G.

Figure 14F:
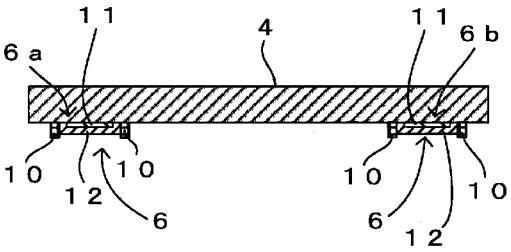

Then, the second resin layer 4 constituting the remaining part of the insulator 2 is prepared, by way of example, as follows. First, as illustrated in FIG. 14E, the undercoating layer 11 of the second conductor 6, having the predetermined pattern shape and being in the form of a line, is formed on or in the lower surface of the second resin layer 4 (i.e., its surface opposing to the first resin layer 3) with a printing process using a conductive paste. Then, the dam member 10 is formed using resin, e.g., polyimide, around the undercoating layer 11 having the predetermined pattern shape and being in the form of a line. Then, as illustrated in FIG. 14F, the second conductor 6 is formed by forming the plating layer 12 with a plating process to cover the undercoating layer 11 in a region of the lower surface of the second resin layer 4 on the inner side surrounded by the dam member 10, thus completing the second resin layer 4 (second resin layer forming step). The plating process is performed plural times as required in order to form plating films of different materials.

Figure 14G:
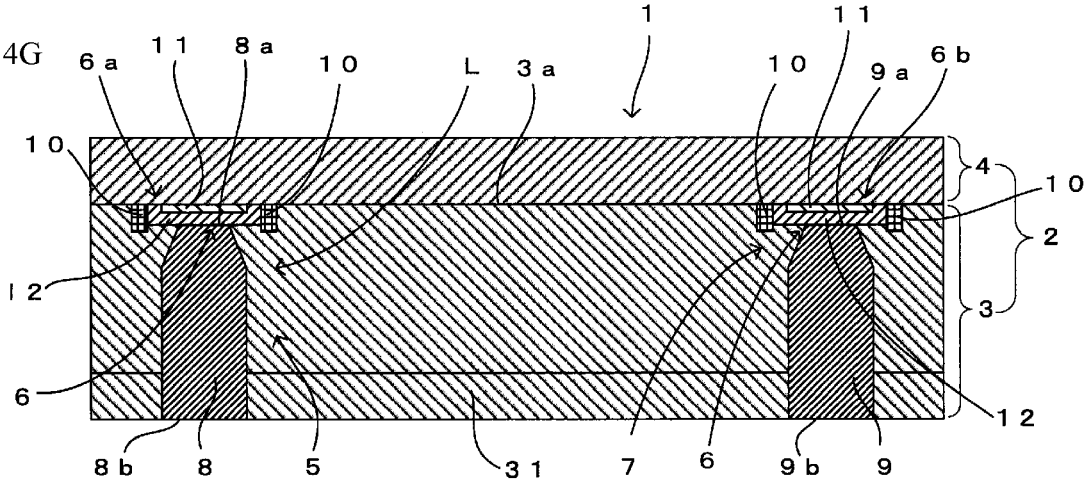

Then, as illustrated in FIG. 14G, the second resin layer 4 is overlaid on the one principal surface 3*a* of the first resin layer 3 in a state of sandwiching, between the second resin layer 4 and the first resin layer 3, the second conductor 6 that is formed on or in the lower surface of the second resin layer 4 to interconnect the respective first end surfaces 8*a* and 9*a* of the first and second metal pins 8 and 9 (second resin layer overlaying step). Then, the first resin layer 3 and the second resin layer 4 are pressed against each other in an overlaying direction under application of ultrasonic vibration in a way of fracturing the surface layer portion of the first resin layer 3 on the side nearer to the one principal surface 3*a* thereof between each of the respective first end surfaces 8*a* and 9*a* of the first and second metal pins 8 and 9 and the second conductor 6. Thus, the first end surface 8*a* of the first metal pin 8 is connected to the first end portion 6*a* of the second conductor 6, and the first end surface 9*a* of the second metal pin 9 is connected to the second end portion 6*b* of the second conductor 6, whereby the inductor electrode 7 of the inductor L is formed (press connection step). As a result, the inductor component 1 is completed.

As in "4. One Example of Manufacturing Method" described above, which ones of the steps illustrated in FIGS. 14A to 14D and the steps illustrated in FIGS. 14E and 14F are to be executed first is optionally selectable. As an alternative, those steps may be executed at the same time. Stated in another way, it is just required that the inductor component 1 can be formed by finally laminating the first resin layer 3 and the second resin layer 4, which have been prepared separately.

Thus, as in "4. One Example of Manufacturing Method" described above, the inductor electrode 7 can be obtained in which the resistance is reduced with the feature that the respective first end surfaces 8*a* and 9*a* of the first and second metal pins 8 and 9 are directly connected to each other by the plating layer 12 of the second conductor 6 without interposition of the undercoating layer 11 thereof between them.

According to this embodiment, as described above, the first resin layer 3 is prepared in which the first and second metal pins 8 and 9 constituting the first conductor 5 are buried such that the respective first end surfaces 8*a* and 9*a* of the first and second metal pins 8 and 9 are opposed to the one principal surface 3*a* of the first resin layer 3 with the predetermined distance G held therebetween. Furthermore, the thickness of the surface layer portion of the first resin layer 3, which portion is positioned on the side nearer to the surface of the first resin layer 3 than each of the respective first end surfaces 8a and 9*a* of the first and second metal pins 8 and 9, is set to the value by which the first resin layer 3 is to be fractured in the press connection step. Therefore, the first resin layer 3 is pushed and fractured by the tapered end portions of the first and second metal pins 8 and 9 on the same side as the first end surfaces 8*a* and 9*a* when, in the press connection step, the first resin layer 3 and the second resin layer 4 are pressed against each other in the overlaying direction with proper pressing force in a way of fracturing the first resin layer 3 between each of the respective first end surfaces 8*a* and 9*a* of the first and second metal pins 8 and 9 and the second conductor 6.

As a result, the respective first end surfaces 8*a* and 9*a* of the first and second metal pins 8 and 9 are connected to the second conductor 6, whereby the inductor electrode 7 of the inductor L is formed. Thus, since a step of grinding or polishing the end portions of the first and second metal pins 8 and 9 or the resin of the first resin layer 3 is no longer required unlike the related art, the inductor component 1 can be manufactured at a lower cost.

Furthermore, the respective end portions of the first and second metal pins 8 and 9 on the same side as the first end surfaces 8*a* and 9*a* are each formed in the tapered shape. Accordingly, when the respective first end surfaces 8*a* and 9*a* of the first and second metal pins 8 and 9 are connected to the second conductor 6, an angle $\alpha$ formed between a peripheral surface of each of the end portions of the first and second metal pins 8 and 9 on the same side as the first end surfaces 8*a* and 9*a* and the surface of the second conductor 6 is an acute angle larger than 0° and smaller than 90°. Therefore, when the inductor electrode 7 is heated up to high temperature and the first and second metal pins 8 and 9 are expanded because of a current flowing through the inductor electrode 7 or due to a heat cycle in a process of mounting the inductor component 1 to any of various substrates, the respective end portions of the first and second metal pins 8 and 9 on the same side as the first end surfaces 8*a* and 9*a* are expanded in such a way that the peripheral surfaces of those end portions are bulged toward the first end surfaces 8*a* and 9*a*, i.e., toward the second conductor 6 to which the first end surfaces 8*a* and 9*a* are connected.

Thus, because stresses are generated in directions of pressing, toward the second conductor 6, the resins covering the peripheral surfaces of the respective end portions of the first and second metal pins 8 and 9 on the same side as the first end surfaces 8*a* and 9*a*, slippage can be prevented from occurring between the one principal surface 3*a* of the first resin layer 3 and the second conductor 6 near the respective first end surfaces 8*a* and 9*a* of the first and second metal pins 8 and 9. As a result, the inductor component 1 in which the second conductor 6 of the inductor electrode 7 is prevented from peeling off from the one principal surface 3*a* of the first resin layer 3 can be manufactured at a lower cost.

Since the ultrasonic vibration is applied in the press connection step, the surface layer portion of the first resin layer 3, which portion is positioned on the side nearer to the surface of the first resin layer 3 than each of the respective first end surfaces 8*a* and 9*a* of the first and second metal pins 8 and 9, can be fractured reliably. The connection strength between each of the respective first end surfaces 8*a* and 9*a* of the first and second metal pins 8 and 9 and the second conductor 6 can also be increased with the application of the ultrasonic vibration.

Moreover, the second conductor 6 is constituted by the undercoating layer 11 formed of the conductive paste, and the plating layer 12 formed to cover the undercoating layer 11. Accordingly, the second conductor 6 constituting a part of the inductor electrode 7 can be formed at a lower cost. Since the respective first end surfaces 8*a* and 9*a* of the first and second metal pins 8 and 9 are directly connected to each other by the plating layer 12 of the second conductor 6 without interposition of the undercoating layer 11 thereof between them, the resistance of the inductor electrode 7 can be reduced at a lower cost.

Since the respective first end surfaces 8*a* and 9*a* of the first and second metal pins 8 and 9 are directly connected to each other by the plating layer 12 of the second conductor 6, the connection strength between each of the respective first end surfaces 8*a* and 9*a* of the first and second metal pins 8 and 9 and the second conductor 6 (specifically, the plating layer 12) can be increased.

In the inductor component 1 described above, a very small inductance value required in an electronic circuit to which a high-frequency signal is input can be easily obtained.

In addition, the inductor component 1 having a practical structure can be provided in a point of including the inductor L in which the respective second end surfaces 8*b* and 9*b* of the first and second metal pins 8 and 9 of the first conductor 5, those second end surfaces being exposed at the principal surface of the first resin layer 3 on the side oppositely away from the second resin layer 4, can be used as external connection terminals. Since a step of providing the external connection terminals is not needed, the structure of the inductor component 1 is simplified, and this point is also effective in improving reliability of the inductor component 1. Moreover, the inductor component 1 can be manufactured at a lower cost.

The inductor L according to this embodiment may be arranged plural in the form of an array to constitute an inductor component 1 as in the case of the inductor component 200 illustrated in FIG. 9.

(Modifications)

Figure 15A:
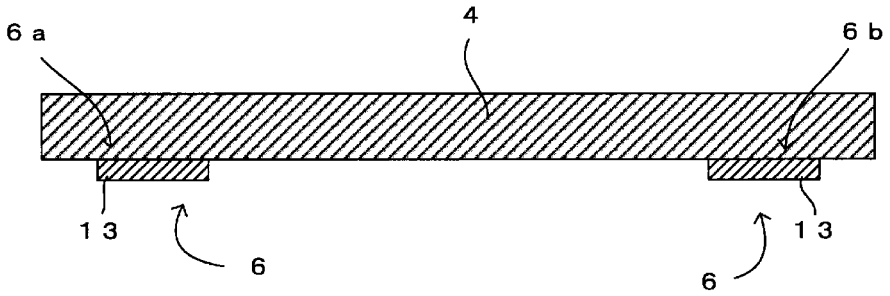
FIGS. 15A and 15B represent different modifications.
Figure 15B:
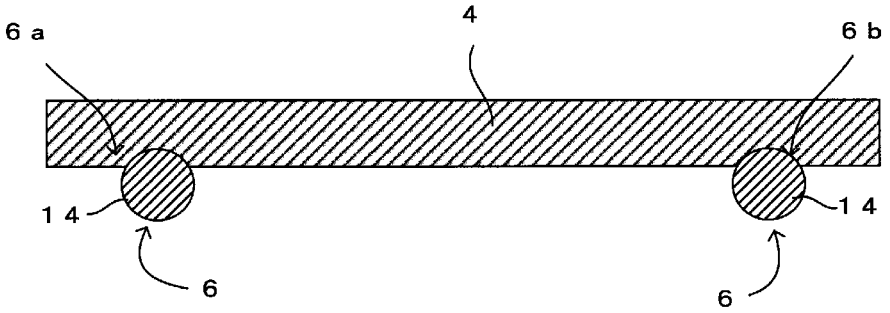

Modifications of the inductor component 1 illustrated in FIG. 1 will be described below with reference to FIGS. 15A and 15B. Each of FIGS. 15A and 15B illustrates the second resin layer 4, and it is a sectional view corresponding to the sectional view taken along the line B-B in FIG. 1 and looking in the direction denoted by arrow. The following description is made mainly about different points in comparison with the above-described inductor component 1 illustrated in FIGS. 10A, 10B and 10C, and similar constituent members to those in the inductor component 1 are denoted by the same reference signs while description of those constituent members is omitted.

In the modification illustrated in FIG. 15A, the second conductor 6 is formed on or in the lower surface of the second resin layer 4 by a wring electrode pattern 13 that is formed through patterning made on a metal plate, a metal film, or a metal foil with etching. In the modification illustrated in FIG. 15B, the second conductor 6 is formed on or in the lower surface of the second resin layer 4 by employing a metal pin 14 that has been bent in advance.

Figure 10A:
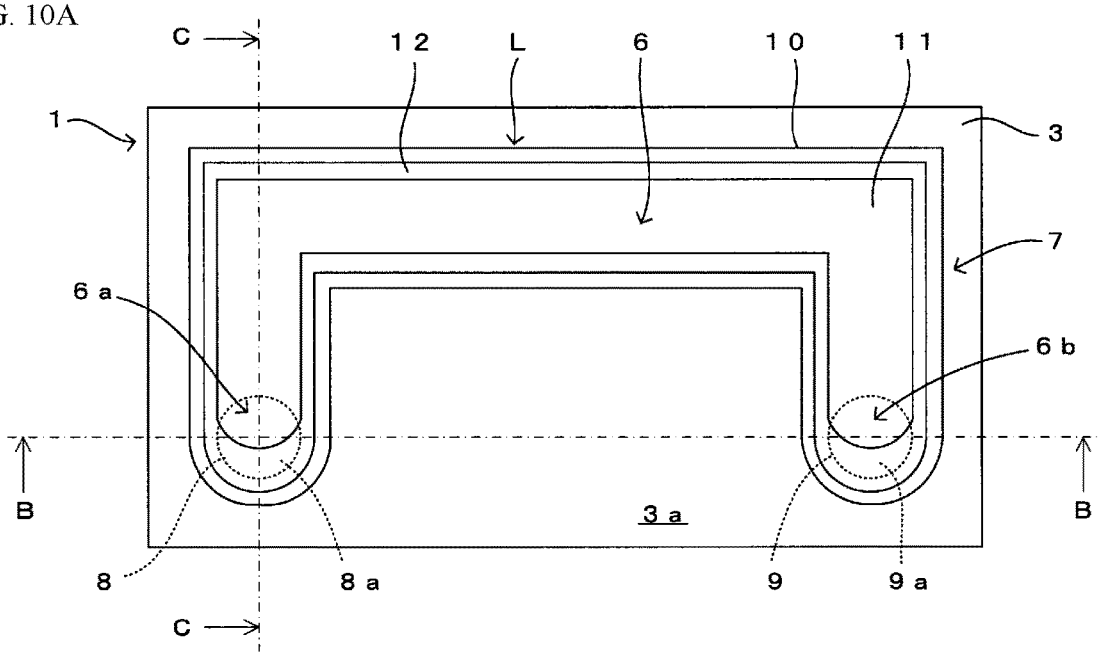
FIG. 10A is a sectional view taken along a line A-A in FIG. 1 and looking in a direction denoted by the arrow.
Figure 10B:
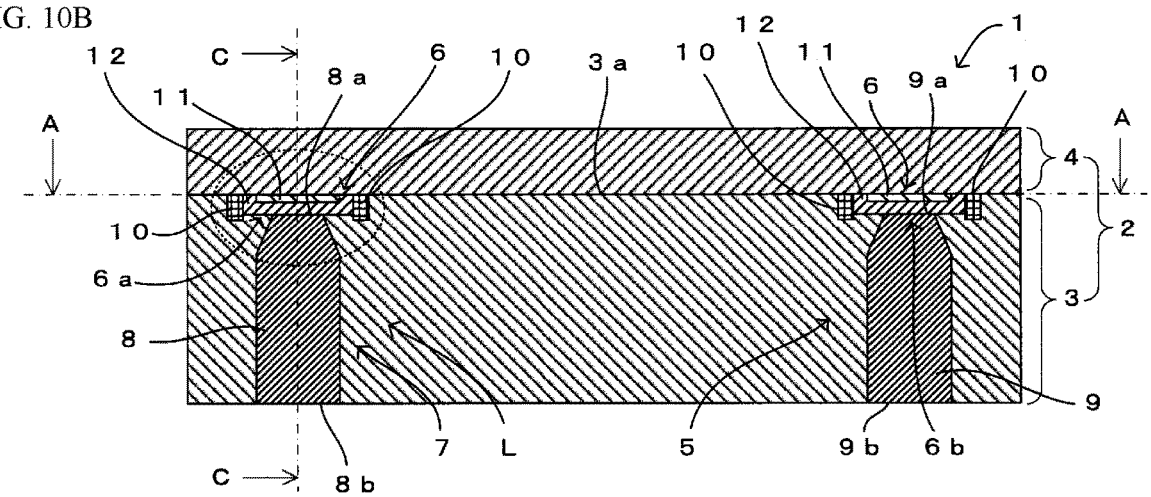
FIG. 10B is a sectional view taken along a line B-B in FIG. 10A and looking in a direction denoted by the arrow.
Figure 10C:
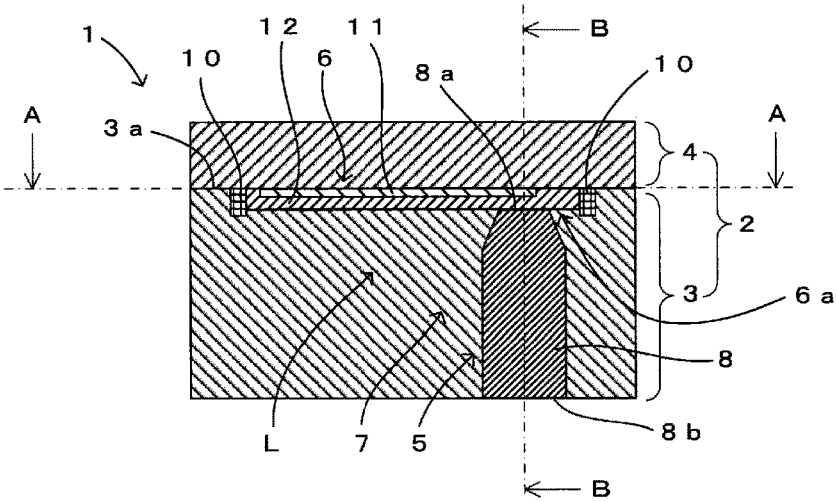
FIG. 10C is a sectional view taken along a line C-C in FIG. 10A and looking in a direction denoted by the arrow.

Even with those modifications, the inductor component 1 having high reliability can be provided which includes the inductor L formed by the inductor electrode 7 having the reduced resistance, as with the embodiment illustrated in FIGS. 10A, 10B and 10C. Furthermore, the inductor component 1 having high reliability can be manufactured at a lower cost in accordance with the manufacturing method described above with reference to FIGS. 12A to 14G.

Fifth Embodiment

A manufacturing method for the inductor component, according to a fifth embodiment of the present disclosure, will be described below with reference to FIGS. 16A and 16B. Each of FIGS. 16A and 16B illustrates the first resin layer 3, and it is a sectional view corresponding to the sectional view taken along the line B-B in FIG. 1 and looking in the direction denoted by arrow.

Figure 16A:
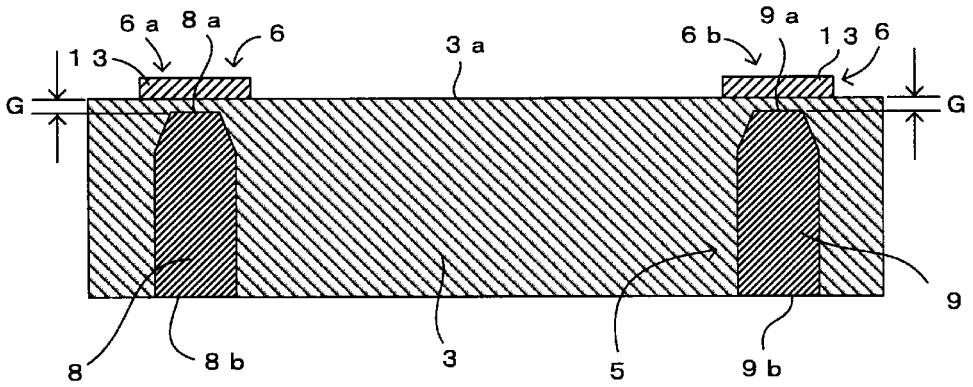
FIGS. 16A and 16B represent different examples.
Figure 16B:
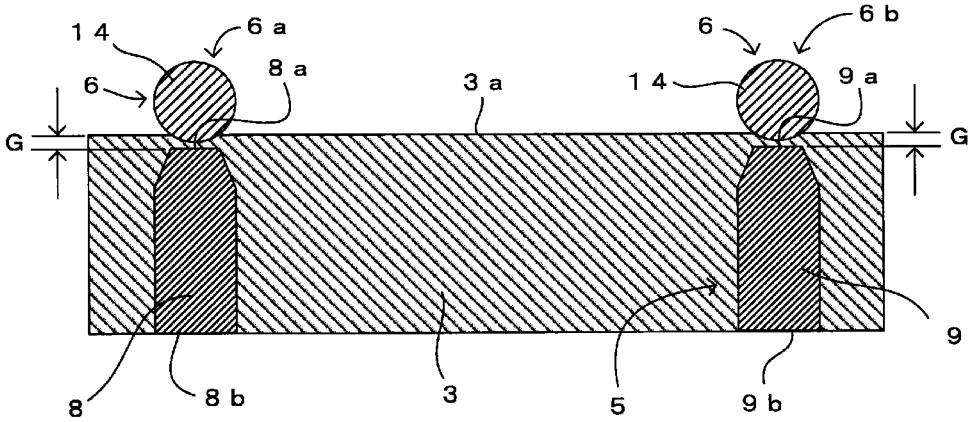

The manufacturing method according to the fifth embodiment is different from the manufacturing method described above in the first embodiment in that, as illustrated in FIGS. 16A and 16B, the second resin layer 4 is laminated on the one principal surface 3*a* of the first resin layer 3 after the second conductor 6 has been formed on or in the one principal surface 3*a* of the first resin layer 3 prepared in the preparation step. The following description is made mainly about different points in comparison with the manufacturing method for the inductor component 1, which has been described above in the first embodiment, and similar steps (constituent members) to those in the above-described manufacturing method according to the first embodiment are denoted by the same reference signs while description of those steps (constituent members) is omitted.

In the manufacturing method illustrated in FIG. 16A, after preparing the first resin layer 3 in the preparation step, the second conductor 6 is formed on or in the one principal surface 3*a* of the first resin layer 3 by employing the wring electrode pattern 13 that is formed through patterning made on a metal plate, a metal film, or a metal foil with etching. The inductor electrode 7 is then formed by overlaying the second resin layer 4 on the first resin layer 3 in the second resin layer overlaying step, and by connecting the respective first end surfaces 8*a* and 9*a* of the first and second metal pins 8 and 9 to the wiring electrode pattern 13 in the press connection step.

In the manufacturing method illustrated in FIG. 16B, after preparing the first resin layer 3 in the preparation step, the second conductor 6 is formed on or in the one principal surface 3*a* of the first resin layer 3 by employing, e.g., the metal pin 14 that has been bent in advance. The inductor electrode 7 is then formed by overlaying the second resin layer 4 on the first resin layer 3 in the second resin layer overlaying step, and by connecting the respective first end surfaces 8*a* and 9*a* of the first and second metal pins 8 and 9 to the metal pin 14 in the press connection step.

According to this embodiment, the inductor component 1 can be manufactured and provided at a lower cost in which the inductor electrode 7 having the reduced resistance is prevented from peeling off from the surface of the first resin layer 3, as in the above-described fourth embodiment.

In the second resin layer overlaying step, the second resin layer 4 may be overlaid on the one principal surface 3*a* of the first resin layer 3 by coating resin, or filling resin, or placing a resin sheet over the one principal surface 3*a* of the first resin layer 3.

Sixth Embodiment

Figure 17:
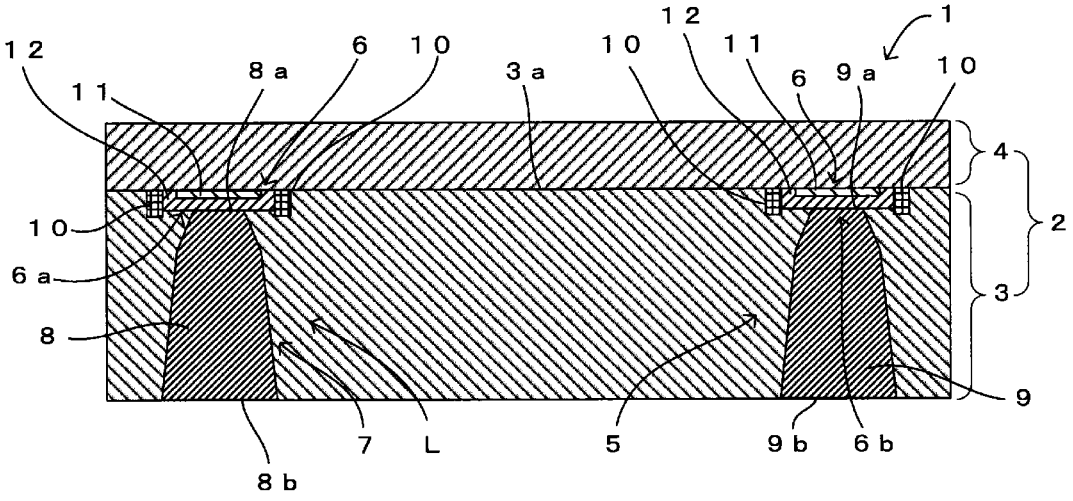
FIG. 17 is a sectional view of an inductor component according to a sixth embodiment of the present disclosure.

An inductor component according to a sixth embodiment of the present disclosure will be described below with reference to FIG. 17. FIG. 17 is a sectional view corresponding to the sectional view taken along the line B-B in FIG. 1 and looking in the direction denoted by arrow.

The inductor component 1 illustrated in FIG. 17 is different from the inductor component 1 illustrated in FIGS. 10A, 10B and 10C in that the respective end portions of the first and second metal pins 8 and 9 on the same side as the second end surfaces 8*b* and 9*b* in shapes gradually thickening toward the second end surfaces 8*b* and 9*b*, whereby the second end surfaces 8*b* and 9*b* are formed respectively to have areas larger than cross-sectional areas of other portions of the first and second metal pins 8 and 9, which portions are buried in the first resin layer 3. Because the other constituent members are similar to those of the inductor component 1 illustrated in FIGS. 10A, 10B and 10C, those constituent members are denoted by the same reference signs while description of those constituent members is omitted.

(Modification)

Figure 18:
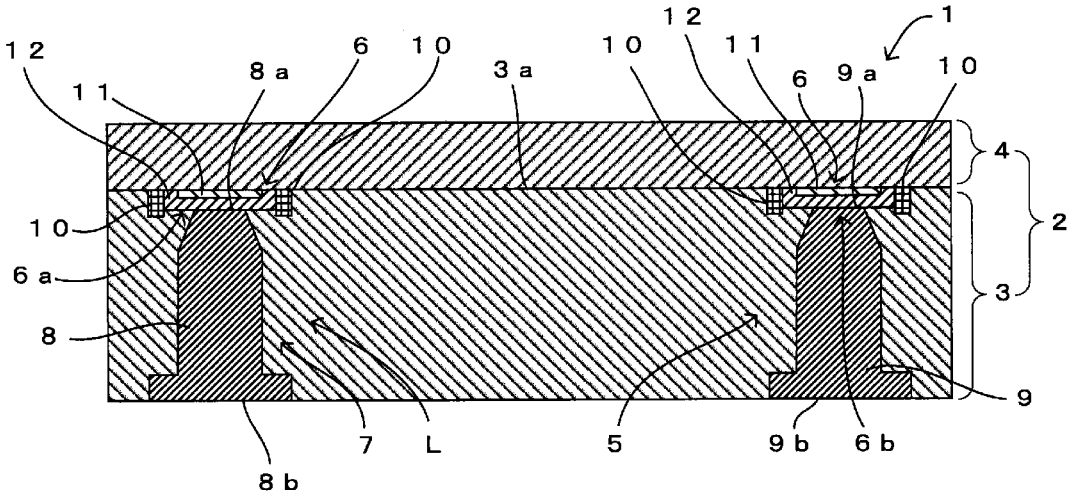
FIG. 18 is a sectional view illustrating a modification of the inductor component illustrated in FIG. 17.

A modification of the inductor component 1 illustrated in FIG. 17 will be described below with reference to FIG. 18. FIG. 18 is a sectional view corresponding to the sectional view taken along the line B-B in FIG. 1 and looking in the direction denoted by arrow.

In the modification illustrated in FIG. 18, the respective end portions of the first and second metal pins 8 and 9 on the same side as the second end surfaces 8*b* and 9*b* are formed in larger diameters than the other portions of the first and second metal pins 8 and 9 such that the first and second metal pins 8 and 9 are each formed in a substantially inverted-T shape when viewed from a side. As a result, the respective areas of the second end surfaces 8*b* and 9*b* are larger than cross-sectional areas of the other portions of the first and second metal pins 8 and 9, which portions are buried in the first resin layer 3. Because the other constituent members are similar to those of the inductor component 1 illustrated in FIGS. 10A, 10B and 10C, those constituent members are denoted by the same reference signs while description of those constituent members is omitted.

With the feature described above, since the second end surfaces 8*b* and 9*b* of the first and second metal pins 8 and 9 functioning as external connection terminals are formed respectively to have the areas larger than the cross-sectional areas of the other portions of the first and second metal pins 8 and 9, connection areas of the external connection terminals can be increased. Hence bonding strength in mounting the inductor component 1 to a circuit board of an electronic device, etc. can be increased.

Seventh Embodiment

Figure 19:
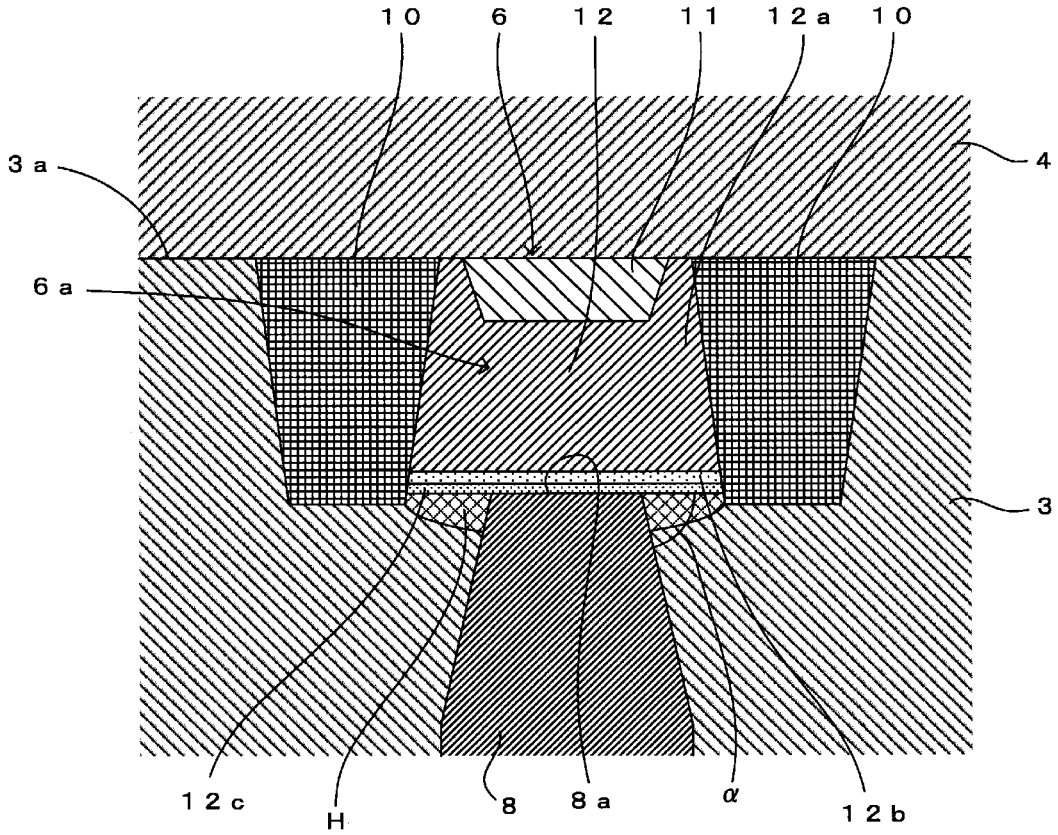
FIG. 19 is a partial enlarged view of an inductor component according to a seventh embodiment of the present disclosure.

An inductor component according to a seventh embodiment of the present disclosure will be described below with reference to FIG. 19. FIG. 19 is a sectional view corresponding to FIG. 11 that has been referenced to explain the fourth embodiment.

As illustrated in FIG. 19, the seventh embodiment is different from the above-described first embodiment in that the respective first end surfaces 8*a* and 9*a* of the first and second metal pins 8 and 9 are each bonded to the second conductor 6 with a solder H. Because the other constituent members are similar to those in the above-described first embodiment, those constituent members are denoted by the same reference signs while description of those constituent members is omitted.

With the feature described above, since the second conductor 6 of the inductor electrode 7 can be prevented from peeling off from the surface of the first resin layer 3 in a region near each of the respective first end surfaces 8*a* and 9*a* of the first and second metal pins 8 and 9 where the solder H is applied for the connection to the second conductor 6, the inductor component 1 having high reliability can be provided in which the occurrence of a drawback, such as solder flash, is avoided.

Eighth Embodiment

An inductor component according to an eighth embodiment of the present disclosure will be described below.

A basic structure of an inductor component 100 is described with reference to FIGS. 20A and 20B. FIG. 20B illustrates the inductor component 100 of FIG. 20A when looked at from the upper side in the drawing sheet, and it corresponds to the sectional view taken along the line A-A in FIG. 1 and looking in the direction denoted by arrow. For the sake of simplicity of explanation, in FIGS. 20A and 20B referenced in the following description, configurations of electrodes, etc. are schematically illustrated, and the first and second metal pins 8 and 9, the second conductor 6, and the third conductor 102 are partly omitted from the drawing. Detailed description of the omitted parts is omitted in the following.

Figure 20A:
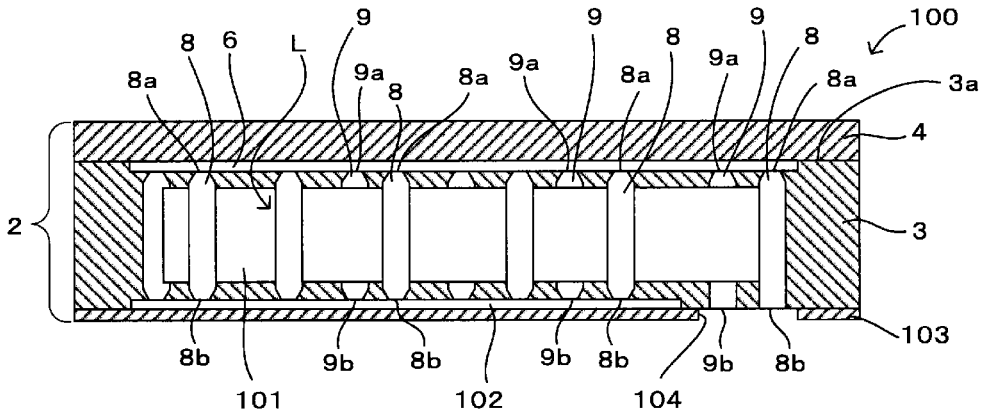
FIG. 20A is a partly sectioned view.
Figure 20B:
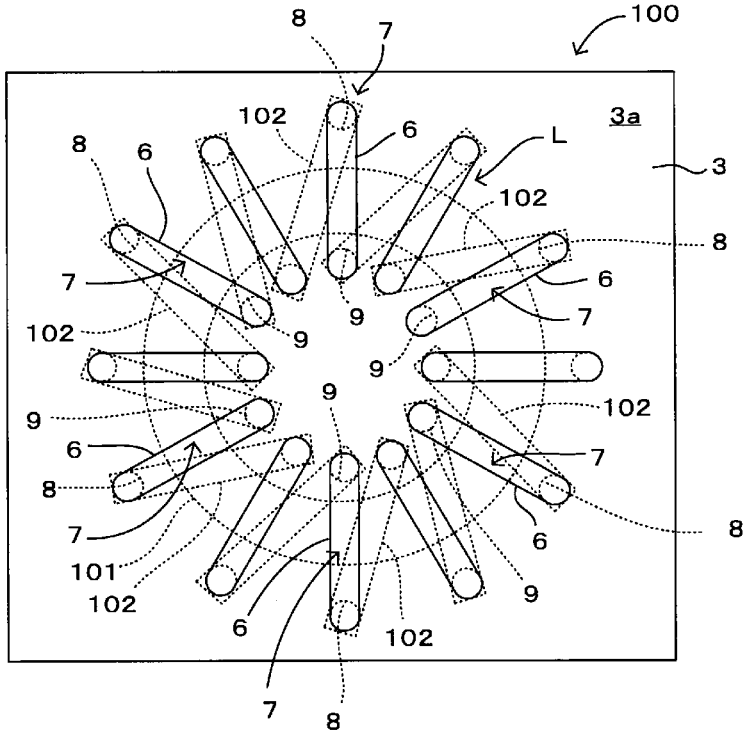
FIG. 20B is an explanatory view referenced to explain a connection state of first and second metal pins that form an inductor electrode.
Figure 21:
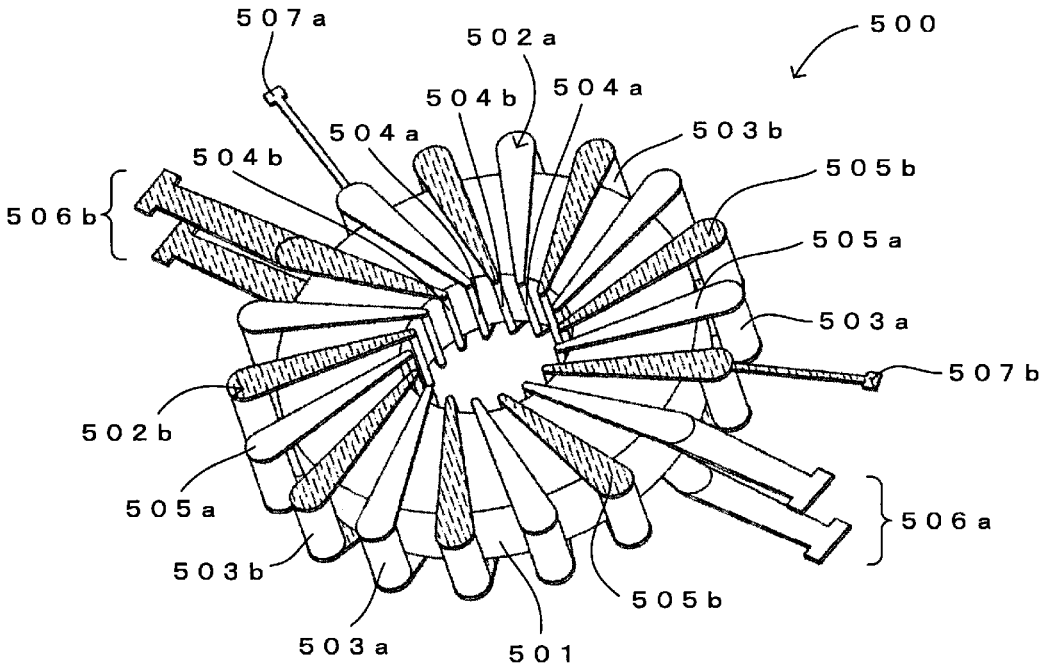
FIG. 21 illustrates an inductor component of related art.

The inductor component 100 of this embodiment is different from the inductor component 1 illustrated in FIGS. 10A, 10B and 10C in that, as illustrated in FIGS. 20A and 20B, the inductor component 100 includes a coil core 101 disposed between the first and second metal pins 8 and 9 in a state buried in the first resin layer 3. Furthermore, opposite end portions of each of the first and second metal pins 8 and 9 are formed in tapered shapes. In the preparation step, the first resin layer 3 is prepared in which a surface layer portion of the first resin layer 3, the portion being positioned on the side nearer to the surface of the first resin layer 3 than each of the second end surfaces 8*b* and 9*b*, is formed in a thickness corresponding to the distance G as in the side including the first end surfaces 8*a* and 9*a*. Then, in the press connection step, the surface layer portion of the first resin layer 3, formed in the thickness corresponding to the distance G, is pushed and fractured, as in the side including the first end surfaces 8*a* and 9*a*, by the respective end portions of the first and second metal pins 8 and 9 on the same side as the second end surfaces 8*b* and 9*b*, whereby the respective end portions of the first and second metal pins 8 and 9 on the same side as the second end surfaces 8*b* and 9*b* are connected to the third conductor 102. The following description is made mainly about different points in comparison with the above first embodiment, and similar constituent members to those in the above first embodiment are denoted by the same reference signs while description of those constituent members is omitted.

As illustrated in FIGS. 20A and 20B, the coil core 101 has an annular shape, and the plurality of inductor electrodes 7 are arrayed along a circumferential direction of the coil core 101 in such a state that the first metal pins 8 are arranged on the outer peripheral side of the coil core 101, that the second metal pins 9 are arranged on the inner peripheral side of the coil core 101, and that the respective first end surfaces 8*a* and 9*a* of the first and second metal pins 8 and 9 are connected to each other by the second conductor 6. Furthermore, the second end surface 8*b* of the first metal pin 8 of one inductor electrode 7 and the second end surface 9*b* of the second metal pin 9 of another inductor electrode 7, which is positioned adjacent to the one inductor electrode 7 on the predetermined side ("counterclockwise side" in this embodiment), are connected to each other by one of the plurality of third conductors 102 each being in the form of a line. Thus, in the inductor component 100, an inductor L formed by the plurality of inductor electrodes 7, which are arranged to spirally extend around the coil core 101, is disposed inside the insulator 2.

Each of the third conductors 102 is formed, in a similar structure to that of the above-described second conductor 6, on a principal surface of a third resin layer 103 on the side opposing to the first resin layer 3, the third resin layer 103 being disposed on the lower surface side of the first resin layer 3. More specifically, though not illustrated, the third conductor 102 is formed by an undercoating layer, and a plating layer covering the undercoating layer. The corresponding second end surfaces 8*b* and 9*b* of the first and second metal pins 8 and 9 are directly connected to each other by the plating layer of the third conductor 102 without interposition of the undercoating layer thereof between them. Also in this embodiment, the second conductor 6 and the third conductor 102 may be each formed by the wiring electrode pattern 13 or the metal pin 14 as illustrated in FIG. 15A or 15B.

In this embodiment, an opening 104 is formed in a predetermined region of the third resin layer 103. External connection terminals of the inductor component 100 are formed at a position of the opening 104 by the respective second end surfaces 8*b* and 9*b* of the first and second metal pins 8 and 9, which are exposed at the surface of the first resin layer 3. Furthermore, in this embodiment, the insulator 2 does not contain magnetic filler, and it is formed of a general thermosetting resin, e.g., an epoxy resin. As in the above-described first embodiment, the material of the insulator 2 is not limited to the thermosetting resin, e.g., the epoxy resin.

The inductor component 100 can be manufactured in accordance with any of the manufacturing methods described above with reference to FIGS. 12A to 14G. In accordance with the manufacturing method illustrated in FIG. 12, for example, in the step illustrated in FIG. 12A, the plurality of first conductors 5 may be arrayed on the coupling plate 20 along a predetermined region where the coil core 101 is disposed, such that the first and second metal pins 8 and 9 sandwich the predetermined region. After disposing the coil core 101 in the predetermined region, the first resin layer 3 may be formed in the step illustrated in FIG. 12B. In accordance with the manufacturing method illustrated in FIGS. 13A to 13G, for example, in the step illustrated in FIG. 13A, a predetermined region having substantially the same shape as the coil core 101 when viewed from above may be set on the transfer plate 30, and the plurality of first conductors 5 may be arrayed along the predetermined region such that the first and second metal pins 8 and 9 sandwich the predetermined region. Then, in the step illustrated in FIG. 13B, the individual first conductors 5 may be transferred from the transfer plate 30 onto the release sheet 40. After removing the transfer plate 30 and arranging the coil core 101 between the first and second metal pins 8 and 9, the first resin layer 3 may be formed in the step illustrated in FIG. 13C.

In accordance with the manufacturing method illustrated in FIGS. 14A to 14G, for example, in the step illustrated in FIG. 14A, a predetermined region having substantially the same shape as the coil core 101 when viewed from above may be set on the transfer plate 30, and the plurality of first conductors 5 may be arrayed along the predetermined region such that the first and second metal pins 8 and 9 sandwich the predetermined region. Then, in the step illustrated in FIG. 14B, the individual first conductors 5 may be transferred from the transfer plate 30 onto the release sheet 40. After arranging the coil core 101 between the first and second metal pins 8 and 9, the first resin layer 3 may be formed in the step illustrated in FIG. 14C.

In the press connection step in each of the manufacturing methods described with reference to FIGS. 12A to 14G, the corresponding second end surfaces 8*b* and 9*b* of the first and second metal pins 8 and 9 may be connected to each other by the third conductor 102 in a manner of overlaying the third resin layer 103, which includes the plurality of third conductors 102 formed thereon, on the first resin layer 3, and by pressing the first to third resin layers 3, 4 and 103 in the overlaying direction, as in the side including the first end surfaces 8*a* and 9*a*. Alternatively, after forming the second conductor 6 on or in the one principal surface 3*a* (upper surface) of the first resin layer 3 in a similar manner to the manufacturing method described with reference to FIGS. 16A and 16B, and after forming the third conductor 102 on or in the lower surface of the first resin layer 3, the second resin layer 4 and the third resin layer 103 may be overlaid on both the surfaces of the first resin layer 3, respectively, and the press connection step may be then executed.

Also in this embodiment, the coil core may be formed in a linear shape or a substantially C-shape as illustrated in FIG. 8A or 8B. In other words, the coil core may be formed in any desired shape.

It is to be noted that the present disclosure is not limited to the above-described embodiments. Insofar as not departing from the gist of the present disclosure, the present disclosure can be modified in various ways in addition to the above-described modifications, and the above-described constituent members may be combined with each other in suitable ways. For example, in each of the step illustrated in FIG. 4G, FIG. 5G, the step illustrated in FIG. 12F, the step illustrated in FIG. 13G, and the step illustrated in FIG. 14G, the second conductor 6 (dam member 10) may be partly or entirely pressed into the second resin layer 4. Furthermore, the third conductor 102 on the third resin layer 103, illustrated in FIGS. 7A and 20A, may be pressed into the third resin layer 103.

The first and second columnar conductors may be each made of a conductive material formed into a columnar shape, such as a hardened conductive paste having a columnar shape, a plated metal material having grown into a predetermined columnar shape with plating, or a columnar sintered body of metal powder. The shape of each of the first and second columnar conductors is not limited to a linear shape, and each columnar conductor may be formed in a circular arc shape, or may be bent into a crank-like shape, for example. Here, the expression "columnar shape" may be replaced with "wire-like shape" or "linear material shape". Thus, the columnar conductor implies a conductor having a shape similar to that of a wire or a linear material formed in a predetermined length, like each of the first and second metal pins 8 and 9. A conductor obtained, for example, by curving the wire or the linear material into a circular arc shape or by bending it into a crank-like shape as described above, is also included in the concept of the columnar conductor.

While, in the above embodiments, the first insulating layer and the second insulating layer in the present disclosure are formed of resin, the first insulating layer and the second insulating layer in the present disclosure may be each formed of an insulating material, e.g., a ceramic material or a glass substrate, other than resin. Alternatively, the first insulating layer and the second insulating layer in the present disclosure may be formed of different types of materials.

In the press connection step, without utilizing ultrasonic vibration, the respective first end surfaces 8*a* and 9*a* of the first and second metal pins 8 and 9 may be connected to the second conductor 6 with pressure bonding, and the respective second end surfaces 8*b* and 9*b* thereof may be connected to the third conductor 102 with pressure bonding. The second conductor 6 and the third conductor 102 may be each formed by applying a conductive paste.

After the step illustrated in FIG. 13C or after the step illustrated in FIG. 14D, only the principal surface of the first resin layer 3 on the side oppositely away from the second resin layer 4 may be ground or polished such that the respective second end surfaces 8*b* and 9*b* of the first and second metal pins 8 and 9 are surely exposed at the surface of the first resin layer 3. Even in that case, the inductor component having high reliability can be manufactured at a lower cost because of no need of grinding or polishing the one principal surface 3*a* of the first resin layer 3.

The present disclosure can be widely applied to an inductor component including an inductor disposed in an insulator, and to a manufacturing method for the inductor component.

1, 100, 200 inductor component
2 insulator
3 first resin layer (first insulating layer)
3*a* one principal surface
4 second resin layer (second insulating layer, insulating layer)
5 first conductor
6 second conductor (conductor)
6*a* first end portion
6*b* second end portion
7 inductor electrode
8 first metal pin (first columnar conductor)
9 second metal pin (second columnar conductor)
8*a*, 9*a* first end surface
8*b*, 9*b* second end surface
11 undercoating layer
12 plating layer
101, 111, 121 coil core
G distance
H solder
L inductor
W1 width of plating layer
W2 maximum width of first end surface

The invention claimed is:

1. An inductor component comprising:

an insulator including a first insulating layer and a second insulating layer laminated on the first insulating layer; and an inductor disposed in the insulator, wherein the inductor includes an inductor electrode, the inductor electrode comprising:

a first conductor comprising first and second columnar conductors both buried in the first insulating layer in a state that respective first end surfaces of the first and second columnar conductors are located at a surface of the first insulating layer on a side opposing to the second insulating layer; and a second conductor disposed on or in a surface of the second insulating layer on side opposing to the first insulating layer, the second conductor being connected to the first end surface of the first columnar conductor, and the second conductor being connected to the first end surface of the second columnar conductor, the second conductor includes an undercoating layer comprising a conductive paste, and the second conductor includes a plating layer covering the undercoating layer, and the plating layer is connected to the respective first end surfaces of the first and second columnar conductors to connect the first and second columnar conductors to each other without an interposition of the undercoating layer between the first and second columnar conductors.

2. The inductor component according to claim 1, wherein the plating layer is bonded to the respective first end surfaces of the first and second columnar conductors by utilizing ultrasonic vibration, and the first and second columnar conductors are connected to each other only by the plating layer.

3. The inductor component according to claim 1, further comprising a coil core disposed between the first and second columnar conductors, and buried in the first insulating layer.

4. The inductor component according to claim 1, wherein the second conductor is in a form of a line, has a first end portion connected to the first end surface of the first columnar conductor, and has a second end portion connected to the first end surface of the second columnar conductor, the plating layer in the first end portion of the second conductor has a width larger than a maximum width of the first end surface of the first columnar conductor, and the plating layer in the second end portion of the second conductor has a width larger than a maximum width of the first end surface of the second columnar conductor.

5. The inductor component according to claim 4, wherein the respective second end surfaces of the first and second columnar conductors of the first conductor are exposed at a principal surface of the first insulating layer on a side oppositely away from the second insulating layer.

6. The inductor component according to claim 4, wherein each of the first and second columnar conductors comprises a metal pin.

7. The inductor component according to claim 4, wherein the plating layer is bonded to the respective first end surfaces of the first and second columnar conductors by utilizing ultrasonic vibration, and the first and second columnar conductors are connected to each other only by the plating layer.

8. The inductor component according to claim 1, wherein each of the first and second columnar conductors comprises a metal pin.

9. The inductor component according to claim 8, wherein respective end portions of the first and second columnar conductors on a side of the first end surfaces are each in a tapered shape gradually thinning toward a tip end.

10. The inductor component according to claim 9, wherein the first conductor and the second conductor are bonded to each other with a solder.

11. The inductor component according to claim 1, wherein the respective second end surfaces of the first and second columnar conductors of the first conductor are exposed at a principal surface of the first insulating layer on a side oppositely away from the second insulating layer.

12. The inductor component according to claim 11, wherein each of the first and second columnar conductors comprises a metal pin.

13. The inductor component according to claim 11, wherein the plating layer is bonded to the respective first end surfaces of the first and second columnar conductors by utilizing ultrasonic vibration, and the first and second columnar conductors are connected to each other only by the plating layer.

14. The inductor component according to claim 11, wherein an area of the second end surfaces is larger than a cross-sectional area of other portions of the first and second columnar conductors.

15. The inductor component according to claim 14, wherein each of the first and second columnar conductors comprises a metal pin.

16. The inductor component according to claim 14, wherein the plating layer is bonded to the respective first end surfaces of the first and second columnar conductors by utilizing ultrasonic vibration, and the first and second columnar conductors are connected to each other only by the plating layer.

* * * * *